US007547833B2

(12) United States Patent
Yamashita

(10) Patent No.: US 7,547,833 B2
(45) Date of Patent: Jun. 16, 2009

(54) KEY DRIVING APPARATUS AND KEYBOARD MUSICAL INSTRUMENT

(75) Inventor: Masayoshi Yamashita, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 37 days.

(21) Appl. No.: 11/715,445

(22) Filed: Mar. 8, 2007

(65) Prior Publication Data

US 2007/0234890 A1 Oct. 11, 2007

(30) Foreign Application Priority Data

Mar. 24, 2006 (JP) ..... P 2006-082351

(51) Int. Cl.
*G10H 1/18* (2006.01)

(52) U.S. Cl. ..... 84/18; 84/22; 84/730

(58) Field of Classification Search ..... 84/600, 84/18, 22, 730; 310/328
See application file for complete search history.

(56) References Cited

U.S. PATENT DOCUMENTS

| | | | | |
|---|---|---|---|---|
| 3,580,979 | A * | 5/1971 | Amano | 84/688 |
| 5,627,333 | A * | 5/1997 | Stahnke et al. | 84/462 |
| 6,229,247 | B1 * | 5/2001 | Bishop | 310/328 |
| 6,233,086 | B1 * | 5/2001 | Hardiman | 359/290 |
| 6,263,550 | B1 * | 7/2001 | Seipler et al. | 29/25.35 |
| 6,661,156 | B1 * | 12/2003 | Henneck | 310/328 |
| 6,930,438 | B2 * | 8/2005 | Cramer et al. | 310/328 |
| 6,949,705 | B2 * | 9/2005 | Furukawa | 84/610 |
| 7,017,245 | B2 * | 3/2006 | Baumgartner et al. | 29/25.35 |
| 7,166,795 | B2 * | 1/2007 | Lengeling | 84/737 |
| 7,225,514 | B2 * | 6/2007 | Iwase et al. | 29/25.35 |
| 7,385,134 | B2 * | 6/2008 | Sawada et al. | 84/723 |
| 2003/0177890 | A1 * | 9/2003 | Furukawa | 84/610 |
| 2003/0209131 | A1 * | 11/2003 | Asahi | 84/485 R |
| 2004/0145276 | A1 * | 7/2004 | Cramer et al. | 310/328 |
| 2004/0169442 | A1 * | 9/2004 | Senoo et al. | 310/328 |
| 2004/0174415 | A1 * | 9/2004 | Kojima | 347/72 |
| 2004/0183396 | A1 * | 9/2004 | Iwase et al. | 310/311 |
| 2005/0034591 | A1 * | 2/2005 | Chang | 84/730 |
| 2005/0040733 | A1 * | 2/2005 | Goldenberg et al. | 310/328 |
| 2005/0056139 | A1 * | 3/2005 | Sakurada | 84/616 |
| 2005/0076774 | A1 * | 4/2005 | Sakurada | 84/616 |
| 2005/0204906 | A1 * | 9/2005 | Lengeling | 84/744 |
| 2005/0206274 | A1 * | 9/2005 | Kobane et al. | 310/328 |
| 2006/0196346 | A1 * | 9/2006 | Ohba et al. | 84/616 |
| 2006/0272469 | A1 * | 12/2006 | Meisel | 84/21 |
| 2007/0193436 | A1 * | 8/2007 | Chu | 84/609 |
| 2007/0234887 | A1 * | 10/2007 | Sawada et al. | 84/723 |
| 2007/0234890 | A1 * | 10/2007 | Yamashita | 84/745 |

(Continued)

FOREIGN PATENT DOCUMENTS

JP 59-37594 A 3/1984

(Continued)

*Primary Examiner*—David S. Warren
(74) *Attorney, Agent, or Firm*—Smith Patent Office

(57) ABSTRACT

A key driving apparatus for driving a key may include, but is not limited to, a first elastically deformable unit. The first elastically deformable unit is configured to receive a first control voltage. The first elastically deformable unit is configured to show elastic deformations of stretch and shrinkage based on the level of the first control voltage. The first elastically deformable unit is configured to allow the key to be driven by the elastic deformations of stretch and shrinkage of the first elastically deformable unit.

21 Claims, 9 Drawing Sheets

U.S. PATENT DOCUMENTS

| | | | | |
|---|---|---|---|---|
| 2008/0072743 | A1* | 3/2008 | Ohba et al. | 84/616 |
| 2008/0083314 | A1* | 4/2008 | Hayashi et al. | 84/22 |
| 2008/0092720 | A1* | 4/2008 | Yamashita et al. | 84/600 |
| 2009/0002205 | A1* | 1/2009 | Klinghult et al. | 341/33 |

FOREIGN PATENT DOCUMENTS

| | | | |
|---|---|---|---|
| JP | 6-222752 | A | 8/1994 |
| JP | 2004-294769 | A | 10/2004 |

* cited by examiner

KEY DRIVING APPARATUS AND KEYBOARD MUSICAL INSTRUMENT

BACKGROUND OF THE INVENTION

1. Field of the Invention

The present invention generally relates to a key driving apparatus and a keyboard musical instrument.

Priority is claimed on Japanese Patent Application No. 2006-082351, filed Mar. 24, 2006, the content of which is incorporated herein by reference.

2. Description of the Related Art

All patents, patent applications, patent publications, scientific articles, and the like, which will hereinafter be cited or identified in the present application, will hereby be incorporated by reference in their entirety in order to describe more fully the state of the art to which the present invention pertains.

Conventional keyboard musical instruments such as electronic keyboards and acoustic pianos include a key driving apparatus for driving each key independently. In the keyboard musical instruments, the key driving apparatus drives each key in accordance with a set of performance information. The set of performance information includes a series of musical tones forms a music.

Japanese Unexamined Patent Application, First Publication, No. 59-37594 discloses a conventional key driving apparatus that uses a solenoid as an actuator, to which a driving voltage or a driving signal is supplied so as to drive each key.

Japanese Unexamined Patent Application, First Publication, No. 2004-294769 discloses a conventional key driving apparatus that uses a combination of a stepping motor and a gear mechanism as an actuator, to which a driving voltage or a driving signal is supplied so as to drive each key.

Japanese Unexamined Patent Application, First Publication No. 6-222752 discloses a conventional key driving apparatus that uses a shape memory alloy as an actuator, to which a driving voltage or a driving signal is supplied so as to drive each key.

These conventional key driving apparatuses use the solenoid, the stepping motor in combination with the gear mechanism as the actuators. These conventional key driving apparatuses have relatively large sizes and heavy weights which deteriorate portability of a keyboard musical instrument. Namely, these conventional key driving apparatuses are not suitable for application to portable keyboard musical instruments such as electronic keyboards.

The conventional key driving apparatuses use the actuators that need a large power consumption to obtain a sufficient driving force in an initial phase stage of the key driving operation. These conventional key driving apparatuses are not suitable for the electronic keyboard using a battery.

The conventional key driving apparatus using the shape memory alloy as the actuator can be reduced in size and weight. Deformation of a shape memory alloy is caused by heating or cooling the same. The conventional key driving apparatus using the shape memory alloy can not exhibit large driving force and high driving speed.

In view of the above, it will be apparent to those skilled in the art from this disclosure that there exists a need for an improved key driving apparatus and a keyboard musical instrument. This invention addresses this need in the art as well as other needs, which will become apparent to those skilled in the art from this disclosure.

SUMMARY OF THE INVENTION

Accordingly, it is a primary object of the present invention to provide an improved key driving apparatus.

It is another object of the present invention to provide a key driving apparatus that has reduced size and weight.

It is a further object of the present invention to provide a key driving apparatus that drives each key at a high driving force and a high driving speed with reduced power consumption.

It is a still further object of the present invention to provide a keyboard musical instrument including an improved key driving apparatus.

It is yet a further object of the present invention to provide a keyboard musical instrument including a key driving apparatus that has reduced size and weight.

It is an additional object of the present invention to provide a keyboard musical instrument including a key driving apparatus that drives each key at a high driving force and a high driving speed with reduced power consumption.

In accordance with a first aspect of the present invention, a key driving apparatus for driving a key may include, but is not limited to, a first elastically deformable unit. The first elastically deformable unit is configured to receive a first control voltage. The first elastically deformable unit is configured to show elastic deformations of stretch and shrinkage based on the level of the first control voltage. The first elastically deformable unit is configured to allow the key to be driven by the elastic deformations of stretch and shrinkage of the first elastically deformable unit.

The key driving apparatus may further include, but is not limited to, an interlocking mechanism. The interlocking mechanism may be configured to mechanically interlock the first elastically deformable unit to the key. The interlocking mechanism may be configured to transmit the forces of the elastic deformations of stretch and shrinkage to the key, thereby driving the key.

The interlocking mechanism may be configured to allow the key to be swing-moved around a first fulcrum by the elastic deformations of stretch and shrinkage.

The elastic deformations of stretch and shrinkage may include deformations in directions that are parallel to the direction of swing-motion of the key.

The interlocking mechanism may include, but is not limited to, a swing-movable member that has first and second portions. The first portion may be coupled to the first elastically deformable unit. The second portion may be coupled to the key. The swing-movable member may be configured to be swing-moved around a second fulcrum by the elastic deformations of stretch and shrinkage thereby causing the key to be swing-moved around the first fulcrum.

The interlocking mechanism may include, but is not limited to, a swing-movable member that has first and second portions. The first portion may be configured to be contactable with the first elastically deformable unit. The second portion may be coupled to the key. The swing-movable member may be configured to be swing-moved around a second fulcrum by the elastic deformations of stretch and shrinkage thereby causing the key to be swing-moved around the first fulcrum.

The interlocking mechanism may be configured to allow the key to be swing-moved in a first direction by the elastic deformation of shrinkage of the first elastically deformable unit. The interlocking mechanism may be configured to allow the key to be pushed in the first direction by an external force.

The first elastically deformable unit may include, but is not limited to, electrodes configured to receive the first control voltage, and an elastically deformable polymer film having dielectric property. The elastically deformable polymer film is interposed between the electrodes. The elastically deformable polymer film is configured to show elastic deformations of stretch and shrinkage in the in-plane direction based on the level of the first control voltage.

The first elastically deformable unit may include, but is not limited to a periodic stack of electrodes and elastically deformable polymer films. The electrodes may be configured to receive the first control voltage. The elastically deformable polymer films have dielectric property. The elastically deformable polymer films are configured to show elastic deformations of stretch and shrinkage in the in-plane direction based on the level of the first control voltage.

The first elastically deformable unit may include, but is not limited to, a periodic stack of multi-layered structures and insulating films. Each of the multi-layered structures may further include, but is not limited to, electrodes and an elastically deformable polymer film. The electrodes are configured to receive the first control voltage. The electrodes are adjacent to the insulating films. The elastically deformable polymer film has dielectric property. The elastically deformable polymer film is interposed between the electrodes. The elastically deformable polymer film is configured to show elastic deformations of stretch and shrinkage in the in-plane direction based on the level of the first control voltage.

The key driving apparatus may further include rigid members that sandwich the first elastically deformable unit.

The first elastically deformable unit has first and second portions. The first portion is fixed to a frame. The second portion is interlocked to the key through the interlocking mechanism.

The interlocking mechanism may be configured to apply an additional static force to the key in one of directions along which the key is driven.

The additional static force may be caused by the deadweight of the interlocking mechanism.

The key driving apparatus may further include, but is not limited to, a static force applying mechanism. The static force applying mechanism is configured to apply an additional static force to the key in one of directions along which the key is driven.

The key driving apparatus may further include, but is not limited to, first and second limiting members. The first limiting member may be configured to limit motion of the key thereby defining a first end of a movable range of the key. The second limiting member may be configured to limit motion of the key thereby defining a second end of the movable range of the key. The key is moved from the first end to an intermediate between the first and second ends by the elastic deformations of stretch and shrinkage of the first elastically deformable unit. The key is moved to the second end by an external force.

The key driving apparatus may further include, but is not limited to, a second elastically deformable unit. The second elastically deformable unit may be configured to receive a second control voltage. The second elastically deformable unit may be configured to show elastic deformations of stretch and shrinkage based on the level of the second control voltage. The first and second elastically deformable units may be configured to allow the key to be driven by the elastic deformations of stretch and shrinkage of the first and second elastically deformable unit. The first elastically deformable unit may include a polymer film.

In accordance with a second aspect of the present invention, a keyboard musical instrument may include, but is not limited to, a keyboard having keys, a music performance information generator, a key driving controller, and a key driving apparatus. The music performance information generator may be configured to generate music data for automatic music performance. The key driving controller may be coupled to the music performance information generator to receive the music data from the music performance information generator. The key driving controller may be configured to generate a key driving control signal based on the music data and generate a first control voltage based on the key driving control signal. The key driving apparatus may be coupled to the key driving controller to receive the first control voltage from the key driving controller. The key driving apparatus may further include, but is not limited to, a first elastically deformable unit that is configured to receive the first control voltage. The first elastically deformable unit may be configured to show elastic deformations of stretch and shrinkage based on the level of the first control voltage. The first elastically deformable unit may be configured to allow the key to be driven by the elastic deformations of stretch and shrinkage of the first elastically deformable unit.

The keyboard musical instrument may further include, but is not limited to, a sound generating unit. The sound generating unit is configured to generate musical tones based on the music data. The sound generating unit may be configured to synchronize generation of the musical tones with driving the key.

The keyboard musical instrument may further include, but is not limited to, a detector that is coupled to the keyboard. The detector may be configured to detect that each key is driven and generate a detection signal. The detector may be coupled to the sound generating unit to supply the detection signal to the sound generating unit. The sound generating unit generates the musical tones based on the detection signal.

These and other objects, features, aspects, and advantages of the present invention will become apparent to those skilled in the art from the following detailed descriptions taken in conjunction with the accompanying drawings, illustrating the embodiments of the present invention. The first elastically deformable unit may include a polymer film.

BRIEF DESCRIPTION OF THE DRAWINGS

Referring now to the attached drawings which form a part of this original disclosure.

DETAILED DESCRIPTION OF THE INVENTION

Selected embodiments of the present invention will now be described with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
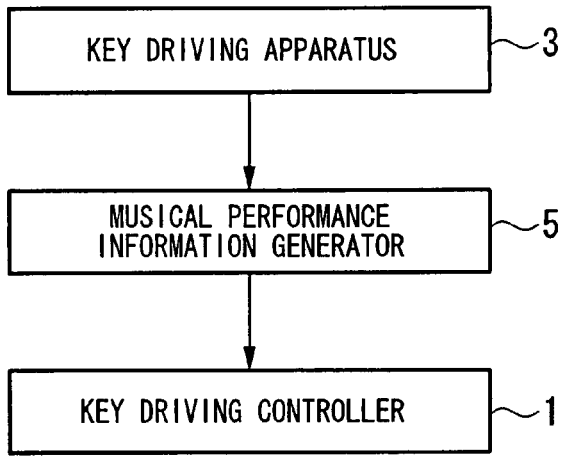
FIG. 1 is a block diagram illustrating a partial configuration of a keyboard musical instrument in accordance with a first embodiment of the present invention.

FIG. 1 is a block diagram illustrating a partial configuration of a keyboard musical instrument in accordance with a first embodiment of the present invention. A keyboard musical instrument may include, but is not limited to, a frame as an enclosure, a keyboard including a plurality of keys, a key driving apparatus 1, a musical performance information generator 3, and a keyboard driving controller 5. The frame and the keyboard are not illustrated. Each key is movably supported by a mechanical supporter. The key driving apparatus 1 includes a plurality of key driving mechanisms, each of which is configured to drive each key independently. The key driving mechanisms each correspond to the keys of the keyboard.

The musical performance information generator 3 is configured to generate a set of musical data for automatic musical performance. The key driving controller 5 is configured to receive the set of musical data from the musical performance information generator 3.

The key driving controller 5 is functionally coupled to the key driving apparatus 1. The key driving controller 5 is configured to control the key driving apparatus 1 so as to drive a selected key or keys in accordance with the set of musical data. The set of music data provides musical information, based on which the keyboard musical instrument will perform. A typical example of the format of musical data may be, but is not limited to, MIDI.

The musical performance information generator 3 may be configured to read musical data from a storage device or medium that may be integrated in the keyboard musical instrument. The musical performance information generator 3 may be configured to supply each musical tone of the musical data to the keyboard driving controller 5. The storage device or medium may be realized by any types of known storage device or medium such as RAMs or ROMs. The set of musical data may include, but is not limited to, sound generation timing formation, note information and other information. The sound generation timing information provides timing of musical tone generation which is based on the speed of music. The note information provides the fundamental frequency of each musical tone of the music. The musical performance information generator 3 transmits each musical tone of the music data to the key driving controller 5 in accordance with the sound generation timing information.

Figure 2:
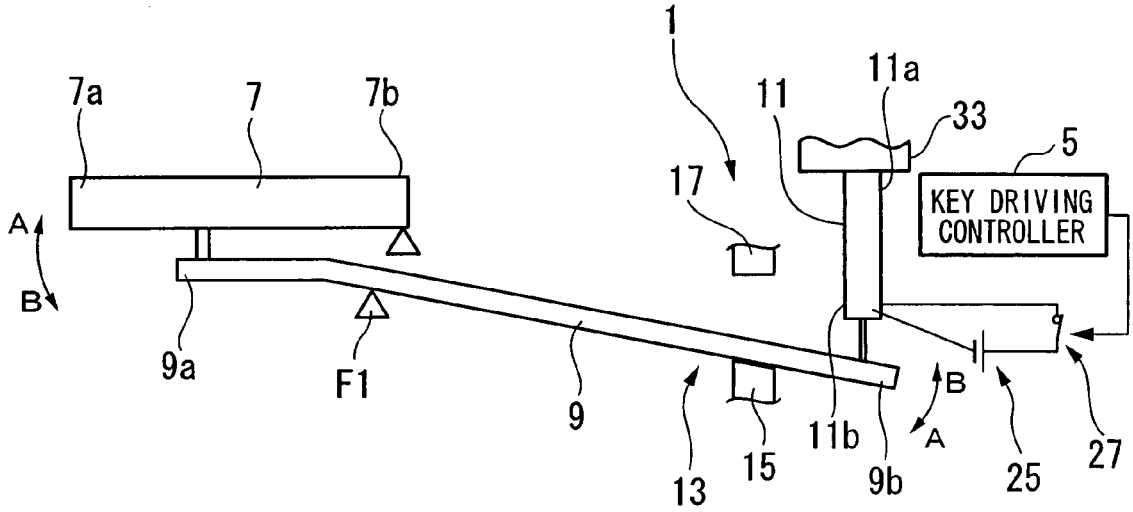
FIG. 2 is a fragmentary cross sectional elevation view illustrating each of plural key driving mechanisms of a key driving apparatus that is included in the keyboard musical instrument shown in FIG. 1.

FIG. 2 is a fragmentary cross sectional elevation view illustrating each of plural key driving mechanisms of the key driving apparatus 1 that is included in the keyboard musical instrument in accordance with the first embodiment of the present invention. The keyboard musical instrument includes a keyboard which further includes a plurality of keys 7. Each key 7 has first and second ends 7*a* and 7*b* opposing each other. Each key 7 has a second fulcrum F2 that is positioned at the second end 7*b*. Each key 7 is swing-movable around the second fulcrum F2. Namely, the first end 7*a* is swing-movable in directions A and B, while the second end 7*b* is fixed at the second fulcrum F2.

As described above, the key driving apparatus 1 includes a plurality of key driving mechanisms, each of which is configured to drive each key independently. The key driving mechanisms each correspond to the keys of the keyboard. Each key driving mechanism included in the key driving apparatus 1 is configured to drive a key so as to cause the key to swing-move in the directions A and B.

The key driving apparatus 1 may operatively be coupled to the plurality of keys of the keyboard. Each of the plural key driving mechanisms of the key driving apparatus 1 may include, but is not limited to, a swingable lever 9, and an elastically deformable film structure 11. The elastically deformable film structure 11 may be realized by a polymer film. The swingable lever 9 is swing-movable at a first fulcrum F1. Namely, the swingable lever 9 is swing-movably supported by the first fulcrum F1. The swingable lever 9 has opposing first and second ends 9*a* and 9*b*. Namely, the swingable lever 9 has a fixed point, at which the movable swingable lever 9 is movably supported by the first fulcrum F1. The fixed point is positioned between the first and second ends 9*a* and 9*b*. The swingable lever 9 extends in a direction which is parallel to and aligned in plan view to the longitudinal direction of the key 7.

The first end 9*a* is positioned under the key 7. For example, the first end 9*a* of the swingable lever 9 is positioned at a middle point between the first and second ends 7*a* and 7*b* of the key 7. The first end 9*a* is mechanically coupled to the key 7. The second end 9*b* is mechanically coupled to the elastically deformable film structure 11. The swingable lever 9 is swing-movable around the first fulcrum F1 so that the first and second ends 9*a* and 9*b* move in the opposite directions represented by the opposing swing directions A and B, while the fixed point of the swingable lever 9 remains unmoved at the first fulcrum F1.

As described above, the first end 9*a* of the swingable lever 9 is mechanically coupled to the key 7, while the second end 9*b* thereof is mechanically coupled to the elastically deformable film structure 11. The swingable lever 9 is interlocked or cooperated with the key 7 so that the swingable lever 9 is swing-moved around the first fulcrum F1 by swing-movement of the key 7 around the second fulcrum F2. The gravity center of the swingable lever 9 is positioned between the first fulcrum F1 and the second end 9*b*. In other words, the gravity center of the swingable lever 9 is displaced from the first fulcrum F1 toward the second end 9*b*. For example, the swingable lever 9 is forced by the deadweight thereof so that the first end 9*a* is forced in the upward direction Awhile the second end 9*b* is forced in the downward direction B. Thus, the key 7 is forced by the deadweight of the swingable lever 9 so that the first end 7*a* is forced in the upward direction A, while the second end 7*b* remains fixed at the second fulcrum F2. The swingable lever 9 has a deadweight that acts as a force-applying member 13, thereby applying the force to the key 7 in the upward direction A. The key 7 is thus interlocked with the weight. The key 7 is stroked while moving the weight. This structure can provide a sense of key-stroking that is similar to the sense of key-stroking of acoustic pianos.

Each of the plural key driving mechanisms of the key driving apparatus 1 may further include first and second limiting members 15 and 17. The first and second limiting members 15 and 17 are fixed relative to the frame of the keyboard musical instrument. As described above, the frame is not illustrated. The first limiting member 15 is positioned under the swingable lever 9 and between the first fulcrum F1 and the second end 9*b* so that the movement of the swingable lever 9 in the direction A is limited by the first limiting member 15. The swingable lever 9 is swing-movable until the level 9 contacts with the first limiting member 15. The second limiting member 17 is positioned over the swingable lever 9 and between the first fulcrum F1 and the second end 9*b* so that the movement of the swingable lever 9 in the direction B is limited by the second limiting member 17. The swingable lever 9 is swing-movable mechanically until the level 9 contacts with the second limiting member 17. Namely, the range of swing motion of the swingable lever 9 is defined by the first and second limiting members 15 and 17. Since the key 7 is interlocked with the swingable lever 9, the range of swing motion of the key 7 is also defined indirectly by the first and second limiting members 15 and 17.

The key 7 is placed at the original position, while the swingable lever 9 contacts with the first limiting member 15. The key 7 is pushed or stroked down from the original position while the swingable lever 9 is swing-moved in the direction B. In other words, the key 7 is pushed or stroked down, while the swingable lever 9 moves toward the second limiting member 17 from the first limiting member 15. When the key 7 is released from the external force application, the swingable lever 9 is swing-moved in the direction A by its deadweight while the key 7 returns to the original position.

Figure 3:
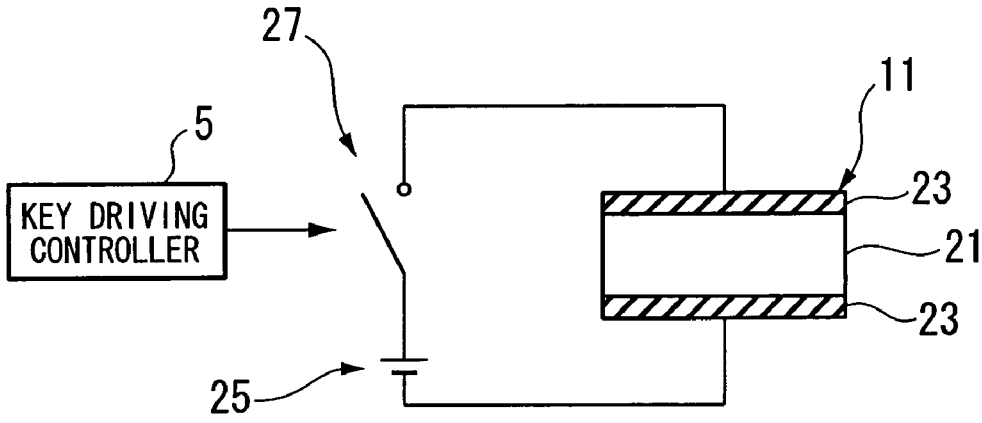
FIG. 3 is a schematic view illustrating a structure of an elastically deformable film structure that is electrically coupled to a key driving controller shown in FIG. 1.

FIG. 3 is a schematic view illustrating a structure of an elastically deformable film structure 11 that is electrically coupled to the key driving controller 5 shown in FIG. 1, wherein no voltage is applied across the elastically deformable film structure 11. As described above, the elastically deformable film structure 11 is included in each key driving mechanism of the key driving apparatus 1. The elastically deformable film structure 11 may include, but is not limited to, an elastomer film 21 and a pair of electrodes 22. The elastomer film 21 has first and second surfaces opposing each other. The paired electrodes 22 are provided on the first and second surfaces of the elastomer film 21. Namely, the paired electrodes 22 sandwich the elastomer film 21. In FIG. 2, one of the paired electrodes 22 is shown.

The elastomer film 21 is elastically deformable. The elastomer film 21 has dielectricity. The elastomer film 21 may be made of a polymer material that has elasticity and dielectricity. In some cases, the elastomer film 21 may be realized by a polymer film such as a silicone resin film or an acrylic-based polymer film. The polymer film may be formed by a spin coater. A typical example of the polymer film may be, but is not limited to, approximately 50 micrometers. In some cases, the paired electrodes 23 may be formed by spraying a carbon particle containing solvent onto the first and second surfaces of the elastomer film 21. The modulus of elasticity of the polymer material of the elastomer film 21 may be preferably at most 10 MPa and more preferably at most 3 MPa. The relative dielectric constant of the polymer material of the elastomer film 21 may be preferably at most 10 and more preferably at most 3. The dielectric breakdown strength of the polymer material of the elastomer film 21 may be preferably in the range of 100 V/μm to 300 V/μm and more preferably in the range of 100 V/μm to 200 V/μm.

The paired electrodes 23 are electrically connected in series to a power supply 25 and a switching circuit 27. The power supply 25 supplies a voltage across the paired electrodes 23. The switching circuit 27 is electrically connected in series to the power supply 25. The series connection of the power supply 25 and the switching circuit 27 is electrically connected between the paired electrodes 23. The switching circuit 27 is further electrically connected to the key driving controller 5 to receive a key driving control signal from the key driving controller 5. The switching circuit 27 is configured to perform open-close operations in accordance with the key driving control signal.

In FIG. 2, the paired electrodes 23 are not shown because the paired electrodes 23 are positioned backside of a surface that is shown as the elastically deformable film structure 11. The thickness direction of the elastically deformable film structure 11 is vertical to the surface that is shown as the elastically deformable film structure 11.

When the switching circuit 27 remains open and no voltage is applied across the paired electrodes 23, the elastically deformable film structure 11 is shrunk in the in-plane direction. The in-plane direction is parallel to the first and second surfaces of the elastomer film 21.

Figure 4:
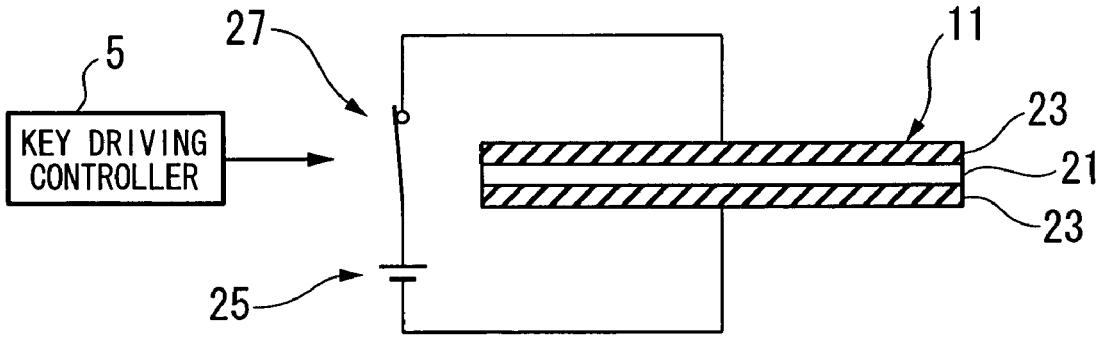
FIG. 4 is a schematic view illustrating the structure of an elastically deformable film structure that is electrically coupled to a key driving controller shown in FIG. 1.

FIG. 4 is a schematic view illustrating the structure of the elastically deformable film structure 11 that is electrically coupled to the key driving controller 5 shown in FIG. 1, wherein a voltage is applied across the elastically deformable film structure 11. The switching circuit 27 is closed and the voltage of the power supply 25 is applied across the paired electrodes 23, thereby causing an electrostatic attraction between the paired electrodes 23. The electrostatic attraction between the paired electrodes 23 causes an elastic deformation of the elastomer film 21. The elastomer film 21 is shrunk in the thickness direction and stretched in the in-plane direction. The thickness direction is vertical to the opposing first and second surfaces of the elastomer film 21. The in-plane direction is parallel to the opposing first and second surfaces of the elastomer film 21. The switching circuit 27 is opened and the voltage application across the paired electrodes 23 is discontinued, thereby causing the elastomer film 21 to be shrunk in the in-plane direction. As a result, the elastomer film 21 returns to the original state. The elastomer film 21 has the original shape.

The key driving controller 5 is configured to generate the key driving control signal. The switching circuit 27 is electrically coupled to the key driving controller 5 to receive the key driving control signal from the key driving controller 5. The switching circuit 27 is configured to perform switching operation based on the key driving control signal. When the switching circuit 27 is closed, the high voltage is applied across the paired electrodes 23 of the elastically deformable film structure 11, thereby causing elastic deformation of stretch in the in-plane direction of the elastomer film 21, namely stretch deformation of the elastically deformable film structure 11. When the switching circuit 27 is opened, no voltage is applied across the paired electrodes 23, thereby causing the elastomer film 21 to be shrunk and return to its original shape, namely the elastically deformable film structure 11 to be shrunk and return to its original shape.

When the elastically deformable film structure 11 has a full deformation of stretch, the swingable lever 9 will contact with the first limiting member 15. The second end 9*b* of the swingable lever 9 is placed at the lowest position. The key 7 is interlocked with the swingable lever 9. The key 7 is also placed in the original position, while the swingable lever 9 is placed in the original position.

When the elastically deformable film structure 11 is free of deformation of stretch and has shrinkage in the in-plane direction, then the swingable lever 9 is swing-moved around the first fulcrum F1. The opposing first and second ends 9*a* and 9*b* are moved down and up, respectively, but the swingable lever 9 does not contact with the second limiting member 17. The key 7 that is interlocked with the swingable lever 9 is also swing-moved around the second fulcrum F2 so that the first end 7*a* is moved down.

Namely, the shrinkage in the in-plane direction of the elastically deformable film structure 11 causes the key 7 to be stroked down. This motion of the key 7 is similar to when the key 7 is pushed down by a finger.

The stretch ratio of the deformed elastomer film 21 in the in-plane direction may depend on the level of the voltage applied across the paired electrodes 23. The elastically deformable film structure 11 made of a polymer has high responsibility or a high speed response to switching operations of the switching circuit 27.

Figure 5:
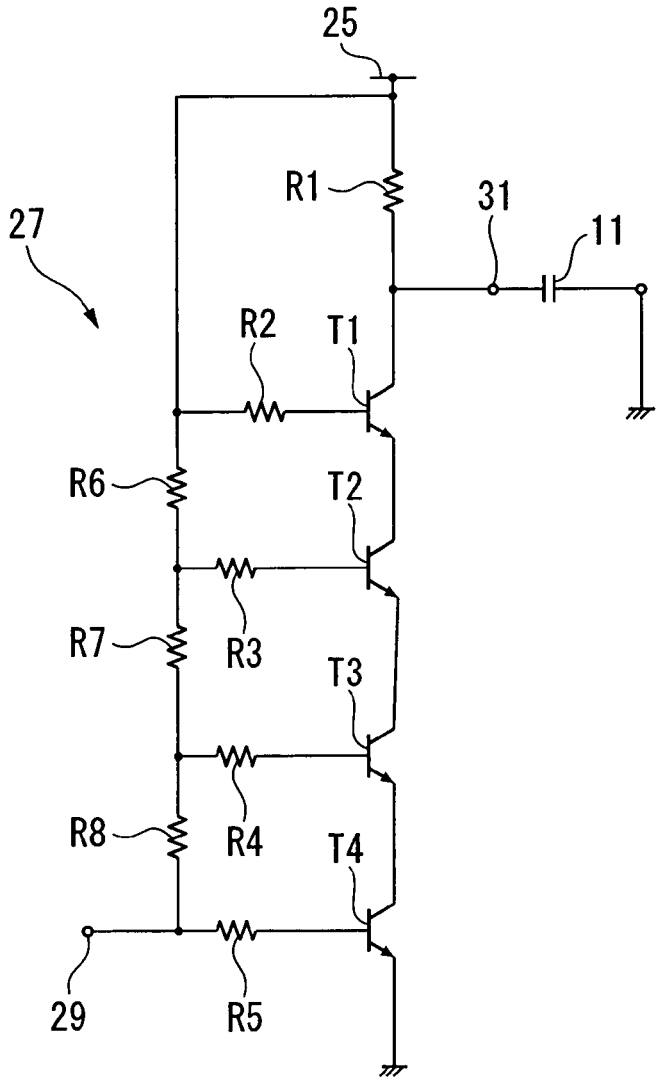
FIG. 5 is a circuit diagram illustrating a switching circuit shown in FIGS. 3 and 4.

FIG. 5 is a circuit diagram illustrating the switching circuit 27 shown in FIGS. 3 and 4. In order to cause the above-described deformation of the elastomer film 21, a high voltage is applied across the paired electrodes 23. A typical example of the applied voltage level may be, but is not limited to, approximately 2 kV. In this case, the switching circuit 27 may be configured as shown in FIG. 5. The switching circuit 27 may have input and output terminals 29 and 31. The switching circuit 27 may be connected between the power supply 25 and the ground. The power supply 25 may be configured to supply the high voltage of approximately 2 kV.

The switching circuit 27 may typically include, but is not limited to, firth to eighth resistances R1, R2, R3, R4, R5, R6, R7 and R8 and first to fourth transistors T1, T2, T3, and T4. The first resistance R1 and the first to fourth transistors T1, T2, T3, and T4 are connected in series between the power supply 25 and the ground. Each of the first to fourth transistors T1, T2, T3, and T4 may be realized by a dipolar transistor. The first resistance R1 and the emitter-collector current paths of the first to fourth transistors T1, T2, T3, and T4 are connected in series between the power supply 25 and the ground. The first resistance R1 is connected between the power supply 25 and the first transistor T1. The output terminal 31 is connected to between the first resistance R1 and the first transistor T1. The sixth, seventh and eighth resistances R6, R7 and R8 are connected in series between the power supply 25 and the input terminal 29.

The first transistor T1 is connected in series between the first resistance R1 and the second transistor T2. The first transistor T1 has a base that is connected to the input terminal 29 through a series connection of the second, sixth, seventh and eighth resistances R2, R6, R7 and R8.

The second transistor T2 is connected in series between the first transistor T1 and the third transistor T3. The second transistor T2 has a base that is connected to the input terminal 29 through a series connection of the third, seventh and eighth resistances R3, R7 and R8.

The third transistor T3 is connected in series between the second transistor T2 and the fourth transistor T4. The third transistor T3 has a base that is connected to the input terminal 29 through a series connection of the fourth and eighth resistances R4 and R8.

The fourth transistor T4 is connected in series between the third transistor T3 and the ground. The fourth transistor T4 has a base that is connected to the input terminal 29 through the fifth resistance R5.

The input terminal 29 is configured to receive the input of the key driving control signal from the key driving controller 5. Each of the first to fourth transistors T1, T2, T3, and T4 is controlled in ON-OFF operation based on the key driving control signal that is input into the input terminal 29. For example, a control voltage is applied to the base of each of the first to fourth transistors T1, T2, T3, and T4, wherein the control voltage is in a predetermined allowable voltage range of each of the first to fourth transistors T1, T2, T3 and T4. An output voltage appears on the output terminal 31 in accordance with the key driving control signal. The output terminal 31 is connected to the ground through the elastically deformable film structure 11.

Figure 6:
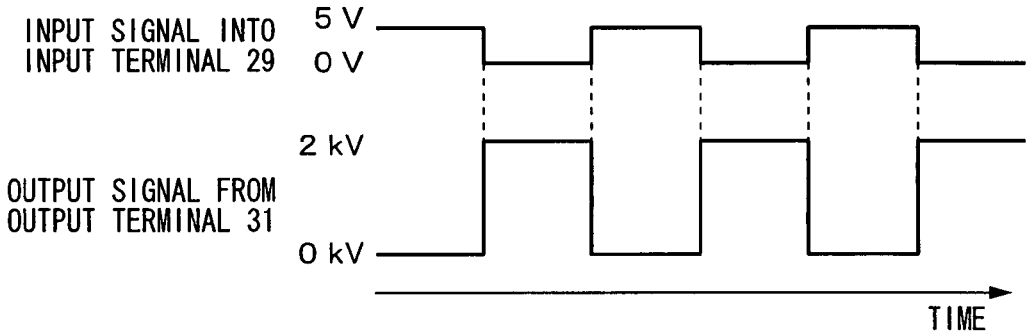
FIG. 6 is a diagram illustrating waveforms of an input signal into an input terminal and of an output signal from an output terminal.

FIG. 6 is a diagram illustrating waveforms of the input signal into the input terminal 29 and of the output signal from the output terminal 31. The input signal that is input into the input terminal 29 has smaller amplitude in the range of 0V to 5V. The output signal that is output from the output terminal 31 has larger amplitude in the range of 0 kV to 2 kV. When the input signal of 0V is input into the input terminal 29, then the output voltage of 2 kV appears on the output terminal 31. When the input signal of 5V is input into the input terminal 29, then the output voltage of 0 kV appears on the output terminal 31. The switching circuit 27 is configured to selectively apply the high voltage output signal across the elastically deformable film structure 11, based on the low voltage input signal.

As described above, the elastically deformable film structure 11 is electrically connected to the switching circuit 27 that is controlled by the key driving controller 5. The elastically deformable film structure 11 is positioned over the second end 9*b* of the swingable lever 9. The elastically deformable film structure 11 has first and second ends 11*a* and 11*b* opposing each other. The first end 11*a* may be mechanically fixed to a fixture 33 that remains fixed relative to the frame. The second end 11*b* of the elastically deformable film structure 11 is mechanically fixed to the second end 9*b* of the swingable lever 9. Shrinkage and stretch deformations in the in-plane direction of the elastically deformable film structure 11 move the second end 9*b* upwardly and downwardly. Namely, these shrinkage and stretch deformations cause the swingable lever 9 to be swing-moved around the first fulcrum F1, thereby causing the key 7 to be swing-moved around the second fulcrum F2.

Figure 7:
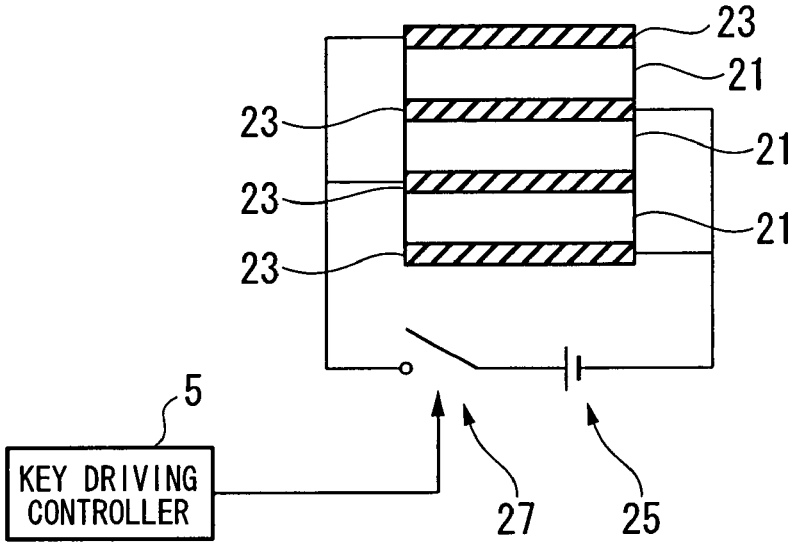
FIG. 7 is a schematic view illustrating a first modified type of an elastically deformable film structure that is electrically coupled to a key driving controller shown in FIG. 1.

FIG. 7 is a schematic view illustrating a first modified type of the elastically deformable film structure 11 that is electrically coupled to the key driving controller 5 shown in FIG. 1. The first modified type of the elastically deformable film structure 11 is configured or designed to increase the force to swing-move the swingable lever 9. The first modified type of the elastically deformable film structure 11 may include, but is not limited to, the periodic stack of elastomer films 21 and electrodes 23, wherein each elastomer film 21 is sandwiched between adjacent two electrodes 23, across which a voltage is selectively applied. The force of shrinkage of the first modified type of the elastically deformable film structure 11 may generally depend on the number of the elastomer films 21 therein. A typical example of the number of stack of elastomer films 21 may be, but is not limited to, about 30-40.

Figure 8:
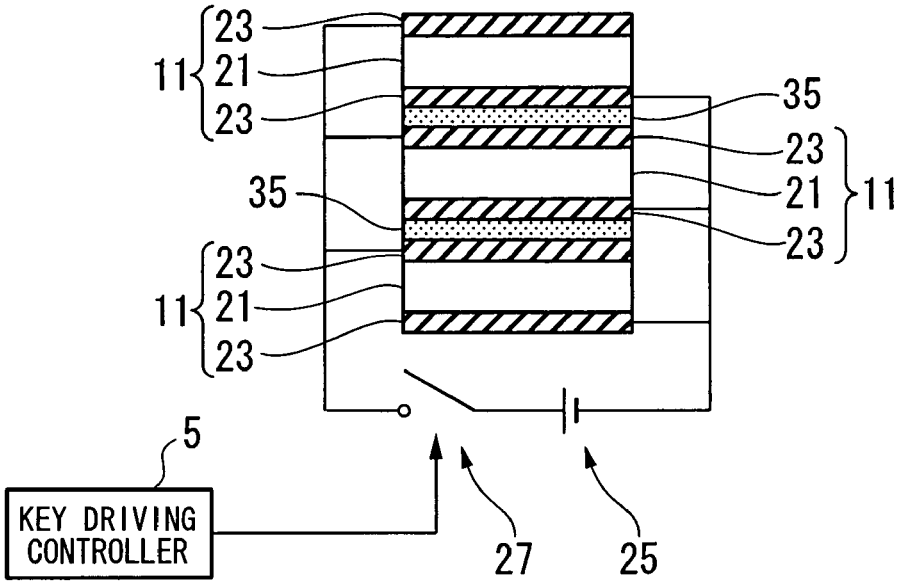
FIG. 8 is a schematic view illustrating a second modified type of the elastically deformable film structure that is electrically coupled to a key driving controller shown in FIG. 1.

FIG. 8 is a schematic view illustrating a second modified type of the elastically deformable film structure 11 that is electrically coupled to the key driving controller 5 shown in FIG. 1. The second modified type of the elastically deformable film structure 11 is configured or designed to increase the force to swing-move the swingable lever 9. The second modified type of the elastically deformable film structure 11 may include, but is not limited to, the periodic stack of insulating films 35 and three-layered structures. The three-layered structure is formed by a single elastomer film 21 and two electrodes 23 sandwiching the single elastomer film 21. Each insulating film 35 is sandwiched between adjacent two three-layered structures of the single elastomer 21 and the two electrodes 23. Each elastomer film 21 is sandwiched between two paired electrodes 23, across which a voltage is selectively applied. The force of shrinkage of the second modified type of the elastically deformable film structure 11 may generally depend on the number of the elastomer films 21 therein. A typical example of the number of stack of elastomer films 21 may be, but is not limited to, about 30-40.

When the elastically deformable film structure 11 is elastically shrunk in the in-plane direction, then the swingable lever 9 is swing-moved around the first fulcrum F1. The opposing first and second ends 9*a* and 9*b* are moved down and up, respectively, but the swingable lever 9 does not contact with the second limiting member 17. The key 7 that is interlocked with the swingable lever 9 is also swing-moved around the second fulcrum F2 so that the first end 7*a* is moved down. Namely, the shrinkage in the in-plane direction of the elastically deformable film structure 11 causes the key 7 to be stroked down. This motion of the key 7 is similar to when the key 7 is pushed down by a finger.

Operations of the key driving apparatus 1 will be described. When the switching circuit is placed in the open state, no voltage is applied across the elastically deformable film structure 11. No electrostatic attraction is caused between the paired electrodes 23 that sandwich the elastomer film 21. Thus, the elastically deformable film structure 11 is shrunk in the in-plane direction, wherein the force of shrinkage exceeds the deadweight of the swingable lever 9 that has the second end 9*b* manically coupled to the second end 11*b* thereof. The elastically deformable film structure 11 is shrunk but the swingable lever 9 does not contact with the second limiting member 17. When the swingable lever 9 contacts with the first limiting member 15 and is placed in the original position, then the elastically deformable film structure 11 has a full deformation of stretch. The key 7 is interlocked with the swingable lever 9. When the swingable lever 9 is placed in the original position, the key 7 is also placed in the original position.

Figure 9:
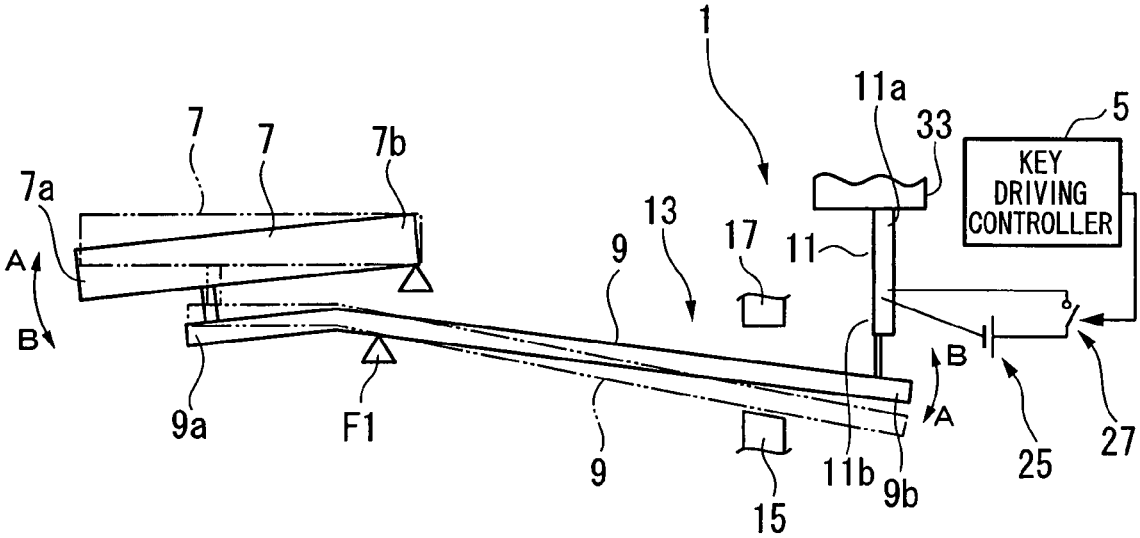
FIG. 9 is a fragmentary cross sectional elevation view illustrating operations of a key driving mechanism shown in FIG. 2.

FIG. 9 is a fragmentary cross sectional elevation view illustrating operations of the key driving mechanism shown in FIG. 2. As shown in FIG. 9, when the switching circuit 27 comes closed based on the key driving control signal that is supplied by the key driving controller 5, the voltage is applied across the elastically deformable film structure 11. An electrostatic attraction is caused between the paired electrodes 23 that sandwich the elastomer film 21. Thus, the elastically deformable film structure 11 is stretched in the in-plane direction by the electrostatic attraction. The elastically deformable film structure 11 is stretched to swing-move the swingable lever 9 until the swingable lever 9 contacts with the first limiting member 15. The stretch in the in-plane direction of the elastically deformable film structure 11 causes swing-motion of the swingable lever 9 around the first fulcrum F1. The opposing first and second ends 9*a* and 9*b* of the lever 9 are moved up and down, respectively, until the swingable lever 9 contacts with the first limiting member 15. The key 7 that is interlocked with the swingable lever 9 is also swing-moved around the second fulcrum F2 so that the first end 7*a* is moved up and is placed in the original position. Namely, the stretch in the in-plane direction of the elastically deformable film structure 11 causes the key 7 to be moved up.

When the switching circuit 27 comes opened based on the key driving control signal that is supplied by the key driving controller 5, no voltage is applied across the elastically deformable film structure 11. No electrostatic attraction is caused between the paired electrodes 23 that sandwich the elastomer film 21. Thus, the elastically deformable film structure 11 is shrunk in the in-plane direction by the electrostatic attraction. The force of shrinkage exceeds the deadweight of the swingable lever 9. The elastically deformable film structure 11 is shrunk to swing-move the swingable lever 9 but the swingable lever 9 does not contact with the second limiting member 17. The shrinkage in the in-plane direction of the elastically deformable film structure 11 causes swing-motion of the swingable lever 9 around the first fulcrum F1. The opposing first and second ends 9*a* and 9*b* of the lever 9 are moved down and up, respectively, but the swingable lever 9 does not contact with the second limiting member 17. The key 7 that is interlocked with the swingable lever 9 is also swing-moved around the second fulcrum F2 so that the first end 7*a* is moved down. Namely, the shrinkage in the in-plane direction of the elastically deformable film structure 11 causes the key 7 to be moved down. This motion of the key 7 is similar to when the key 7 is pushed down by a finger.

The elastically deformable film structure 11 made of a polymer has high responsibility or a high speed response to the switching operations of the switching circuit 27. This can obtain sufficiently large initial driving force and speed of the key 7 in the initial phase of driving the key 7.

After the elastically deformable film structure 11 has been fully stretched, the switching circuit 27 is switched to be opened to discontinue the voltage application across the elastically deformable film structure 11. The elastically deformable film structure 11 is shrunk so that the swingable lever 9 is swing-moved in the direction "B" and the second end 9*b* is moved upwardly.

Shrinkage and stretch deformations in the in-plane direction of the elastically deformable film structure 11 respectively move the second end 9*b* upwardly and downwardly. Namely, these shrinkage and stretch deformations cause the swingable lever 9 to be swing-moved around the first fulcrum F1, thereby causing the key 7 to be swing-moved around the second fulcrum F2.

Figure 10:
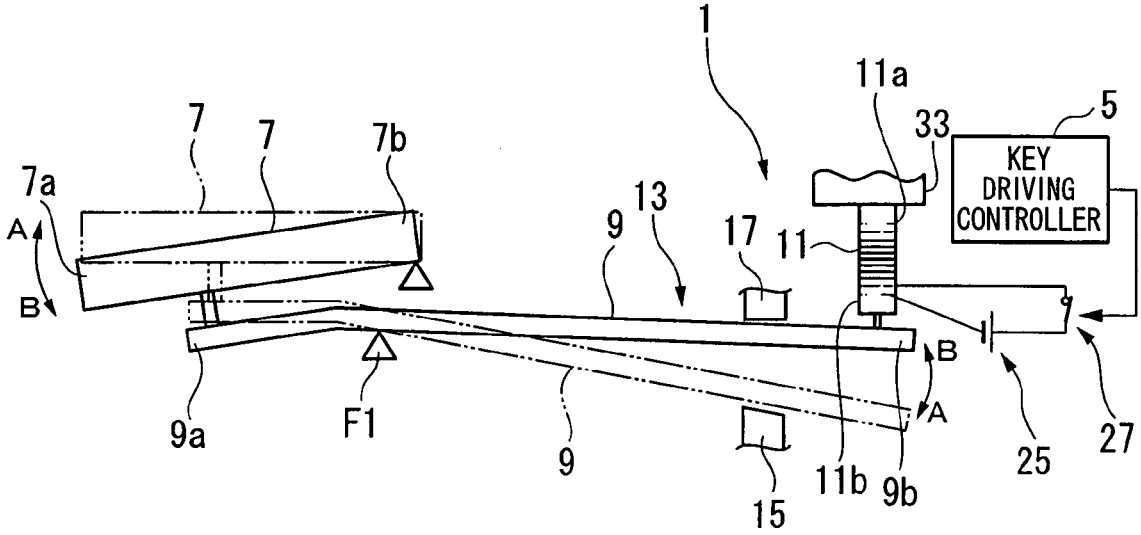
FIG. 10 is a fragmentary cross sectional elevation view illustrating operations of a key driving mechanism shown in FIG. 2 when an external force is applied to a key.
Figure 11:
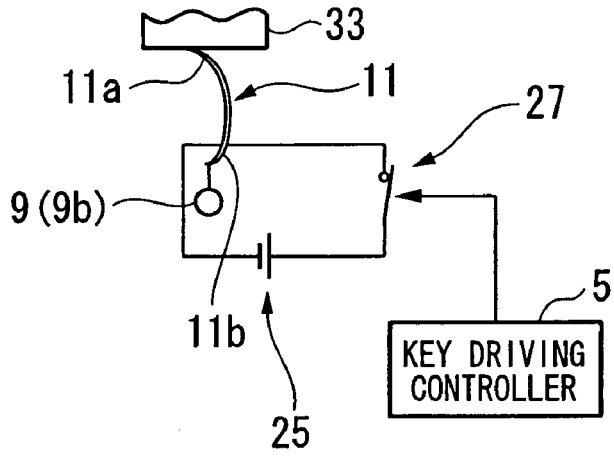
FIG. 11 is a diagram illustrating a schematic mechanism of bending an elastically deformable film structure shown in FIG. 10.

FIG. 10 is a fragmentary cross sectional elevation view illustrating operations of the key driving mechanism shown in FIG. 2 when an external force is applied to the key. FIG. 11 is a diagram illustrating a schematic mechanism of bending the elastically deformable film structure 11 shown in FIG. 10. The elastically deformable film structure 11 with shrinkage or stretch is bendable by applying an external force. A player can push down the key 7 in his or her finger while the switching circuit 27 remains opened to apply no voltage across the elastically deformable film structure 11. Namely, the key 7 is pushed down by a finger and is swing-moved around the second fulcrum F2. The swingable lever 9 that is interlocked with the key 7 is also swing-moved around the first fulcrum F1, wherein the first end 9*a* is moved down while the second end 9*b* is moved up. The elastically deformable film structure 11 is mechanically fixed to the second end 9*b* of the swingable lever 9. The elastically deformable film structure 11 has shrinkage in the in-plane direction. Thus, the further upward motion of the second end 9*b* of the swingable lever 9 bends the elastically deformable film structure 11. Namely, the elastically deformable film structure 11 allows a player to push the key 7 down by his or her finger even when the switching circuit 27 remains opened and no voltage is applied across the elastically deformable film structure 11.

When the switching circuit 27 is closed and the voltage is applied across the elastically deformable film structure 11, then the elastically deformable film structure 11 is stretched in the in-plane direction. The second end 9*b* of the swingable lever 9 is moved down, and the swingable lever 9 contacts with the first limiting member 15. The elastically deformable film structure 11 with stretch is bendable. A player can push the key 7 further down by his or her finger to further swing-move the swingable lever 9 until the swingable lever 9 contacts with the second limiting member 17, while the elastically deformable film structure 11 with stretch is bended.

Figure 12:
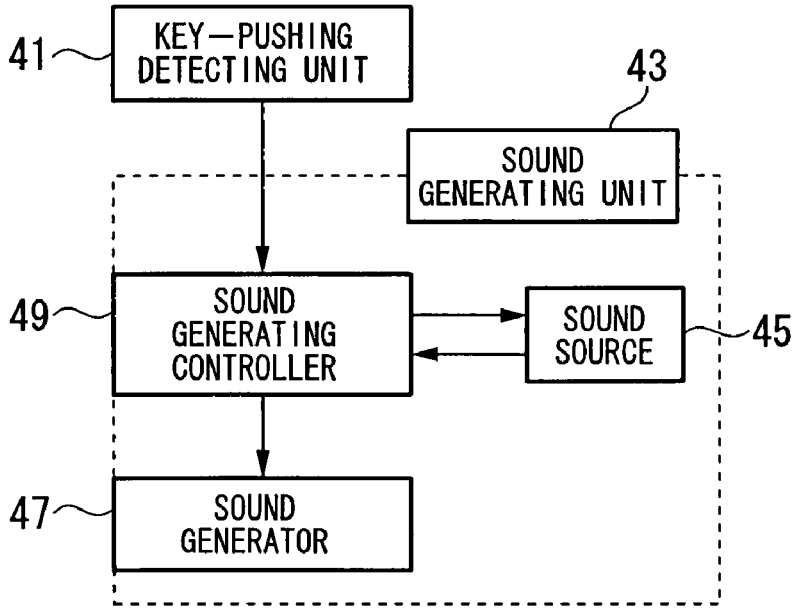
FIG. 12 is a block diagram illustrating additional function units integrated in a keyboard musical instrument that includes a key driving apparatus shown in FIG. 1.

FIG. 12 is a block diagram illustrating additional function units integrated in the keyboard musical instrument that includes the key driving apparatus shown in FIG. 1. The keyboard musical instrument may further include, but is not limited to, a key-pushing detecting unit 41 and a sound generating unit 43. The key-pushing detecting unit 41 is configured to detect that the key 7 and the swingable lever 7 are swing-moved and the swingable lever 9 contacts with the second limiting member 17. The key-pushing detecting unit 41 is configured to generate a detection signal when the key-pushing detecting unit 41 detects the swingable lever 9 contacts with the second limiting member 17.

The sound generating unit 43 is functionally coupled to the key-pushing detecting unit 41 to receive the detection signal from the key-pushing detecting unit 41. The sound generating unit 43 is configured to generate a sound or a tone upon receipt of the detection signal from the key-pushing detecting unit 41. The generated sound or tone is unique to each key 7. The sounds or tones each correspond to the keys 7.

The sound generating unit 43 may further include, but is not limited to, a sound source 45, a sound generator 47, and a sound generating controller 49. The sound source 45 is configured to store data of actual waveforms that include timber and interval that are unique to each key 7. The sound generating controller 49 is functionally coupled to the key-pushing detecting unit 41 to receive the detection signal from the key-pushing detecting unit 41. The sound generating controller 49 is also functionally coupled to the sound source 45. The sound generating controller 49 is configured to read actual waveform data from the sound source 45 based on the detection signal. The sound generator 47 is functionally coupled to the sound generating controller 49 to receive the actual waveform data from the sound generating controller 49. The sound generator 47 is configured to generate a sound in accordance with the actual waveform data. The sound generator 47 may be realized by, but not limited to, an amplifier or a speaker of an audio component.

As described above, the key 7 can be pushed down by a finger of a player so that the swingable lever 9 contacts with the second limiting member 17, whereby the sound generator 47 generates a sound that is unique to the key 7.

The sound generating controller 49 may also be configured to read waveform data from the sound source 45, wherein the waveform data correspond to each musical tone of music data which that is generated by the musical performance information generator 3. The sound generating controller 49 may further be configured to process the waveform data based on the sound generation timing information, note information and other information. The sound generating controller 49 may further be configured to transmit the processed waveform data to the sound generator 47. Namely, the sound generating unit 43 is configured to generate a sound or a tone based on the music data that is generated by the musical performance information generator 3, without using the detection signal from the key-pushing detecting unit 41.

Figure 13:
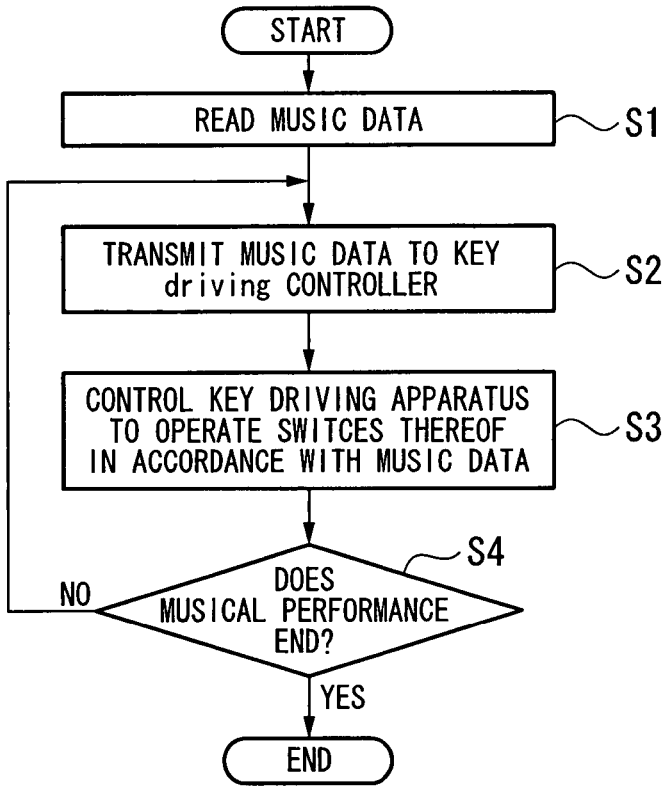
FIG. 13 is a flow chart illustrating operations of a keyboard musical instrument that includes a key driving apparatus shown in FIG. 1.

Operations of the above-described keyboard musical instrument will be described. FIG. 13 is a flow chart illustrating operations of the keyboard musical instrument that includes the key driving apparatus 1 shown in FIG. 1. The switching circuit 27 is previously closed to apply the voltage of the power source 25 across the elastically deformable film structure 11. The elastically deformable film structure 11 is full stretched while the swingable lever 9 contacts with the first limiting member 15.

In Step S1, the musical performance information generator 3 reads the music data that include the sound generation timing information, the note information, and other information.

In Step S2, the musical performance information generator 3 transmits each musical tone of the music data to the key driving controller 5. For example, the musical performance information generator 3 sends each musical tone of the music data to the key driving controller 5, based on the sound generating timing information of the music data.

In Step S3, the key driving controller 5 generates a key driving control signal based on the note information of the music data. The key driving controller 5 transmits the key driving control signal to the switching circuit 27 of each key driving mechanism included in the key driving apparatus 1. The switching circuit 27 is coupled to the key 7 which corresponds to the fundamental frequency of each tone. The switching circuit 27 is switched to be opened upon receipt of the key driving control signal from the key driving controller 5. As a result, the voltage application across the elastically deformable film structure 11 is discontinued, whereby the elastically deformable film structure 11 is shrunk in the in-plane direction. The shrinkage in the in-plane direction of the elastically deformable film structure 11 causes the swingable-lever 9 to be swing-moved around the first fulcrum F1 in the direction B. The force of shrinkage in the in-plane direction of the elastically deformable film structure 11 exceeds the dead-weight of the swingable lever 9. The key 7 that is interlocked with the swingable lever 9 is also swing-moved downwardly around the second fulcrum F2 in the direction B.

During when the sound generation timing information is "ON", the key driving control signal maintains the switching circuit 27 to be opened to apply no voltage across the elastically deformable film structure 11 so that the elastically deformable film structure 11 is maintained to be shrunk. When the music tone of the music data is ended, the key driving controller 5 generates a key driving control signal that places the switching circuit 27 in the closed state, thereby causing the voltage application across the elastically deformable film structure 11. As a result, the elastically deformable film structure 11 is stretched again and the swingable lever 9 is swing-moved around the first fulcrum F1 in the direction "A". Thus, the swingable lever 9 is placed in the initial position, wherein the swingable lever 9 contacts with the first limiting member 15. The key 7 that is interlocked with the swingable lever 9 is also swing-moved around the second fulcrum F2 in the direction "A". Thus the key 7 is placed in the original position.

In Step S4, it is determined whether or not any remaining music tone or tones of the music data that should be transmitted to the key driving controller 5 are present. If it was determined that any remaining music tone or tones are present, then the process will return to the above-described Step 2, so that the musical performance information generator 3 transmits the next musical tone of the music data to the key driving controller 5. If it was determined that any remaining music tone is absent, then operations of driving the key 7 are ended.

In accordance with the above-described operations, the swingable lever 9 is swing-moved around the first fulcrum F1 in the bidirections A and B, wherein the swingable lever 9 does not contact with the second limiting member 17. Thus, the key-pushing detecting unit 41 does not detect the fact that the swingable lever 9 contacts with the second limiting member 17. The sound generating unit 43 does not generate any sound, while the key 7 is half-stroked by the full shrinkage of the elastically deformable film structure 11.

A player or performer pushes the half-stroked key 7 further down by his or her finger until the key 7 is full-stroked while the swingable lever 9 contacts with the second limiting member 17. If the key-pushing detecting unit 41 detects the fact that the key 7 is full-stroked, then the key-pushing detecting unit 41 transmits the detection signal to the sound generating controller 49. The sound generating controller 49 reads actual waveform data from the sound source 45 based on the detection signal. The sound generating controller 49 transmits the actual waveform data to the sound generator 47. The sound generator 47 generates a sound in accordance with the actual waveform data, wherein the sound corresponds to the full-stroked key 7. The above-described keyboard musical instrument can be used to allow a player or performer to practice. The key driving apparatus 1 drives the keys 7 to be half-stroked in accordance with the music data. The half-stroked position of the key 7 gives the player or performer a notice that the half-stroked key 7 should be pushed by his or her finger. Namely, the key driving apparatus 1 provides such player's guide.

The elastic film 21 of the elastically deformable film structure 11 may be made of a polymer which exhibits elastic deformations of shrinkage and stretch in quick response to the switching operation of the switching circuit 27. The elastically deformable film structure 11 makes it possible to obtain sufficiently high initial driving force and speed with reduced power consumption.

The second end 11*b* of the elastically deformable film structure 11 is mechanically fixed to the second end 9*b* of the swingable lever 9. This structure makes it possible to obtain a sufficiently large torque to swing-move the key 7 and the swingable lever 9 even if the force of shrinkage and stretch of the elastically deformable film structure 11 is not large.

The elastically deformable film structure 11 has a relatively simple structure that includes the elastomer film 21 and the paired electrode 23 sandwiching the elastomer film 21. The simple structure of the elastically deformable film structure 11 makes it possible to reduce the weight and size or dimensions thereof.

The simple structure of the elastically deformable film structure 11 makes it possible to simplify the key driving apparatus 1 for driving the key 7. This can reduce the manufacturing cost of the keyboard musical instrument.

As described above, it is possible as a modification that the elastically deformable film structure 11 has a periodic stack structure of the elastomer films 21 and the electrodes 23. It is also possible as another modification that the elastically deformable film structure 11 has a periodic stack structure of the insulating films 35 and the multi-layered structures, each of which includes the elastomer film 21 and the paired electrodes 23 sandwiching the elastomer film 21. These modified types of the elastically deformable film structure 11 will exhibit an increased force of stretch in the in-plane direction thereof without increasing the voltage that is applied to the electrodes 23. These modified types of the key driving apparatus 1 will drive the key 7 at sufficiently large driving force even with reduced power consumption.

The elastically deformable film structure 11 is flexible and bendable independently of whether the voltage is applied across the elastically deformable film structure 11. This can allow a player or performer to push down the key 7 independently of whether the voltage is applied across the elastically deformable film structure 11.

The key driving apparatus 1 drives the key 7 to be half-stroked in accordance with the music data. The half-stroked position of the key 7 gives the player or performer a notice that the half-stroked key 7 should be pushed by his or her finger until the key 7 is full-stroked. The player or performer can practice musical performance not only from view but also from the feeling of finger.

A player or performer can push the half-stroked key 7 further down by his or her finger until the key 7 is full-stroked while the swingable lever 9 contacts with the second limiting member 17. The player or performer can practice musical performance while he or she can feel striking the keys of the keyboard musical instrument.

The player or performer can feel the motion of each key 7 in accordance with the musical data. The keyboard musical instrument assists the player or performer in improving his or her response speed when striking the key 7 with a player's finger. The keyboard musical instrument may allow an amblyopic player or performer to practice without viewing the keyboard.

It is also possible to adjust the level of a voltage that is applied across the elastically deformable film structure 11, wherein the adjustment may be made depending on the sound volume of each tone that is included in the music data. Namely, the amount of stretch or the stretch ratio in the in-plane direction of the elastically deformable film structure 11 can be adjusted by adjusting the voltage that is applied to the paired electrodes 23 of the elastically deformable film structure 11. Thus, the range of swing-motion of the key 7 and the swingable lever 9 can be defined by adjusting the voltage that is applied to the paired electrodes 23 of the elastically deformable film structure 11.

The following can be used to adjust the amount of stretch in the in-plane direction of the elastically deformable film structure 11. A reference voltage is previously set. The reference voltage is applied to cause the elastically deformable film structure 11 to be full-stretched to place the key 7 in the original position. The voltage that is applied across the elastically deformable film structure 11 is reduced to a lower voltage level than the reference voltage level so that the amount of stretch in the in-plane direction of the elastically deformable film structure 11 is reduced depending on the reduced voltage level. As the sound volume is large, the amount of reduction of the voltage is also large. In other words, if the sound volume is large, the voltage is largely reduced. If the maximum sound volume is needed, then the voltage is reduced to zero or no voltage is applied. The amount of swing-stroke of the key 7 depends on the voltage reduction amount. This adjustment of the voltage level allows a player or performer to feel the strong and weak of the musical tone of the music data.

Figure 14:
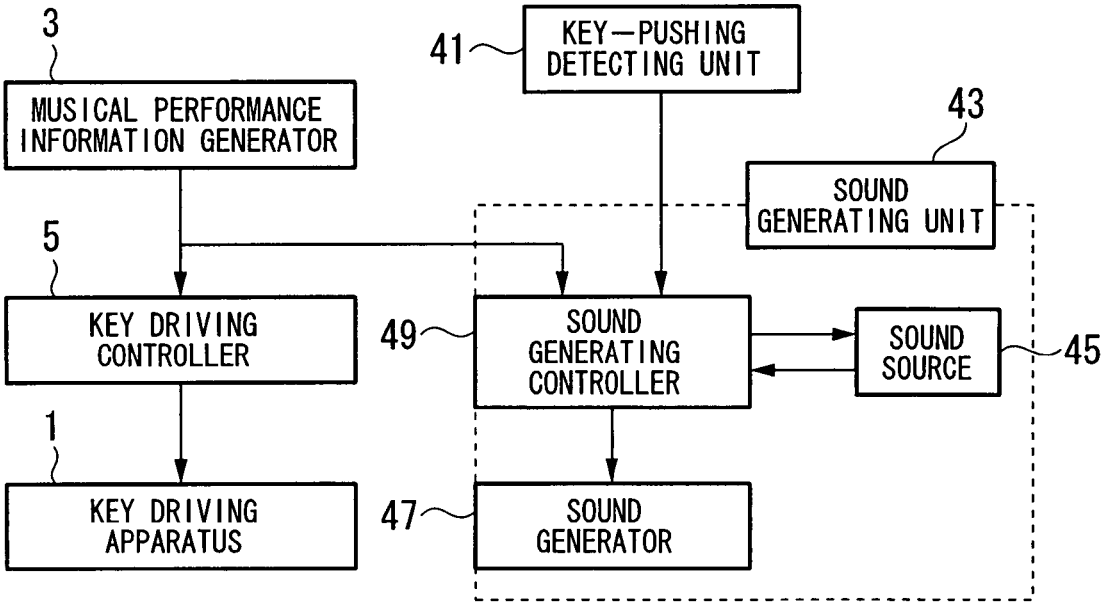
FIG. 14 is a block diagram illustrating configurations of a keyboard musical instrument shown in FIG. 1 and additional function units shown in FIG. 12.

As described above, the sound generator 47 does not generate any sound if the key 7 is half-stroked by the key driving apparatus 1. It is possible as a modification that the sound generating unit 43 is configured to generate a sound, wherein the sound generation is synchronized with when the key driving apparatus 1 drives the key 7 to be half-stroked. FIG. 14 is a block diagram illustrating configurations of the keyboard musical instrument shown in FIG. 1 and the additional function units shown in FIG. 12. As described above, the keyboard musical instrument may include the key driving apparatus 1, the musical performance information generator 3, the keyboard driving controller 5, the key-pushing detecting unit 41 and the sound generating unit 43. The sound generating unit 43 may further include the sound source 45, the sound generator 47 and the sound generating controller 49.

The musical performance information generator 3 generates a set of musical data for automatic musical performance. The musical performance information generator 3 transmits the musical data to both the key driving controller 5 and the sound generating controller 49. The key driving controller 5 controls the key driving apparatus 1 so as to drive a selected key or keys in accordance with the set of musical data. The sound generating controller 49 reads each actual waveform data from the sound source 45 based on each tone of the received musical data. The sound generating controller 49 processes the waveform data based on the sound generation timing information, note information and other information. The sound generating controller 49 transmits the processed waveform data to the sound generator 47 so that the sound generator 47 generates a sound in accordance with the processed waveform data.

This modified configuration of the keyboard musical instrument is configured to perform automatic play based on the given music data. The performance of automatic play utilizes the above-described deformations of shrinkage and stretch in the in-plane direction of the elastically deformable film structure 11. Thus, the performance of automatic play may cause reduced power consumption.

The sound generator 47 is configured to output a first set of waveform data based on the music data that is supplied by the musical performance information generator 3. The sound generator 47 is configured to output a second set of waveform data based on the detection signal that is supplied by the key-pushing detecting unit 41. The first and second sets of waveform data may be identical or different in the musical interval and timber. The sound generation controller 49 may be configured to select the musical interval and timber of the waveform data.

If the first and second sets of waveform data are different from each other, a player or performer can easily compare each tone of the music data to a tone that is generated by striking a key with his or her finger. This allows a player or performer to practice musical performance efficiently.

It is also possible as a modification that the sound generator 47 is configured not to output any waveform data so as to allow a player or performer to practice musical performance in silence.

The musical performance information generator 3 may be configured to supply the key driving controller 5 with each musical tone of music data based on the sound generation timing information that is included in the music data. The sound generator 47 may be configured to output waveform data that correspond to each musical tone.

It is possible as a modification that the musical performance information generator 3 is configured to supply the key driving controller 5 with the next musical tone of music data after the key-pushing detecting unit 41 detects that a key 7 has been pushed down or stroke. The key 7 corresponds to a current musical tone of the music data. It is also possible as a further modification that the sound generator 47 is configured to output waveform data that correspond to each musical tone after the key-pushing detecting unit 41 detects that a key 7 has been pushed down or stroked. The key 7 corresponds to a current musical tone of the music data.

In a typical case, the above-described modifications can be made as follows. The musical performance information generator 3 may be functionally coupled to the key-pushing detecting unit 41 so as to receive the detection signal from the key-pushing detecting unit 41. The musical performance information generator 3 may determine, based on the detection signal, whether or not a key 7 has been pushed down or stroked, wherein the key 7 corresponds to the musical tone of the music data. The musical performance information generator 3 may supply the key driving controller 5 with the next musical tone based on the determination result. The sound generator 47 may output waveform data that correspond to the next musical tone. In such configurations, a player or performer can confirm each key 7 that should be pushed down in performing music. These configurations are suitable for beginners.

The musical performance information generator 3 may be configured to control the timing of transmitting each musical tone of the music data to the key driving controller 5 in accordance with a difference between an actually key-pushing timing and a predetermined ideal timing. The actually key-pushing timing is a time when a player or performer actually pushes down the key 7. The predetermined ideal timing is a time when the key should be pushed down in accordance with the given music data. The sound generator 47 may also be configured to control the timing of outputting waveform data that correspond to each musical tone in accordance with the difference between the actually key-pushing timing and the predetermined ideal timing.

In a typical case, these configurations may be realized as follows. The key-pushing detecting unit 41 transmits the detection signal to the musical performance information generator 3. The musical performance information generator 3 may calculate the difference between the actually key-pushing timing and the predetermined ideal timing, wherein the actually key-pushing timing is based on the detection signal. The musical performance information generator 3 may calculate, based on the calculated difference, the timing of transmitting the next musical tone to the key driving controller 5. The musical performance information generator 3 may calculate, based on the calculated difference, the timing when the sound generator 47 outputs the waveform data that correspond to the next musical tone. Each key 7 is swing-moved to be half-stroked by the key driving apparatus 1, wherein the swing-motion of each key 7 is synchronized with the actual key-pushing timing or the actual performance speed of a player or performer. A player or performer can practice musical performance efficiently even when the actual performance speed has a variation.

As described above, the first end 11*a* of the elastically deformable film structure 11 is fixed to the fixture 33. The second end 11*b* of the elastically deformable film structure 11 is fixed to the second end 9*b* of the swingable lever 9. When the keyboard musical instrument is placed in power OFF, no voltage is applied across the elastically deformable film structure 11. Each key 7 is placed in a half-stroked position or an intermediate position of the swingable range.

It is possible as a modification to provide an additional mechanism that places each key 7 in the initial position or unstroked position when the keyboard musical instrument is placed in power OFF. In a typical case, this additional mechanism can be realized by a motor that moves the fixture 33 toward and away from the second end 9*b* of the swingable lever 9. Namely, the additional mechanism or the motor may be configured to move the fixture 33 closer to the second end 9*b* of the swingable lever 9 when the keyboard musical instrument is placed into the power OFF from the power ON. The additional mechanism or the motor may be configured to move the fixture 33 away from the second end 9*b* of the swingable lever 9 when the keyboard musical instrument is placed into the power ON from the power OFF.

As shown in FIG. 2, the elastically deformable film structure 11 may be positioned over the second end 9*b* of the swingable lever 9. It may be possible to modify the arrangement of the elastically deformable film structure 11 as follows.

Figure 15:
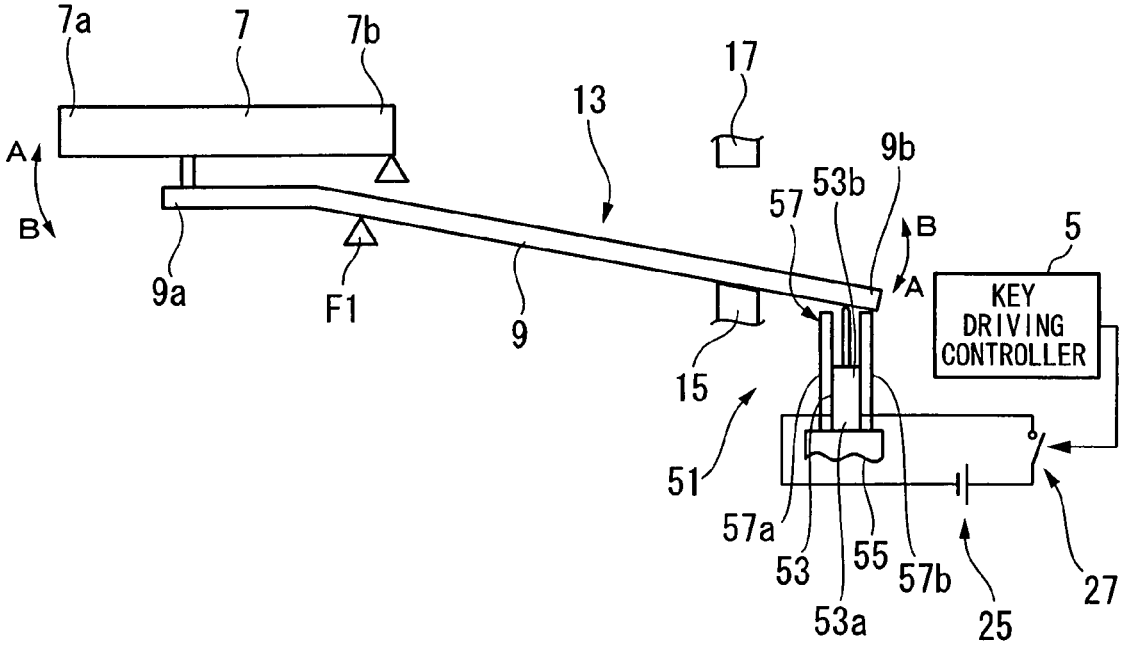
FIG. 15 is a fragmentary cross sectional elevation view illustrating a modified key driving mechanism included in a key driving apparatus that is included in a keyboard musical instrument in accordance with a modified embodiment of the present invention.
Figure 16:
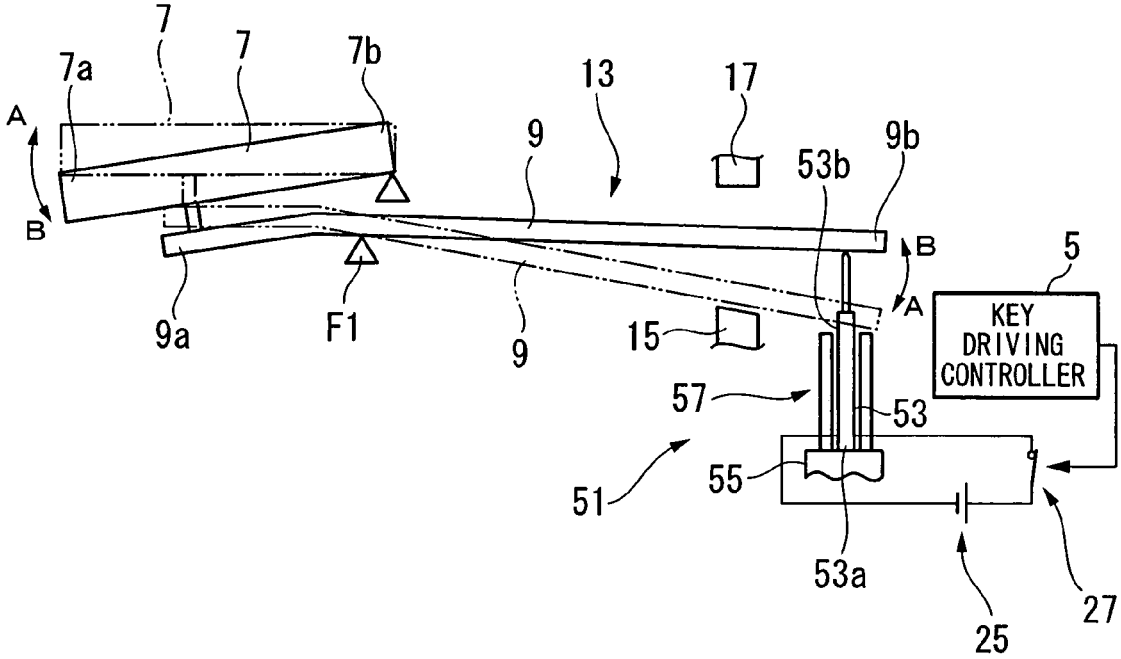
FIG. 16 is a fragmentary cross sectional elevation view illustrating operations of a key driving mechanism shown in FIG. 15.

FIG. 15 is a fragmentary cross sectional elevation view illustrating a modified key driving mechanism included in a key driving apparatus 51 that is included in the keyboard musical instrument in accordance with a modified embodiment of the present invention. FIG. 16 is a fragmentary cross sectional elevation view illustrating operations of the key driving mechanism shown in FIG. 15. A modified key driving mechanism for driving each key 7 is different from the above-described key driving mechanism in the followings. The key driving apparatus 51 may include, but is not limited to, the key 7, the swingable lever 9, and the elastically deformable film structure 53 which is controlled by the key driving controller 5 through the switching circuit 27. Instead of the elastically deformable film structure 11, the elastically deformable film structure 53 is provided under the second end 9*b* of the swingable lever 9. In a typical case, the elastically deformable film structure 53 may have the same multi-layered structure as the elastically deformable film structure 11 as shown in FIGS. 3, 7, and 8.

Namely, the elastically deformable film structure 53 may include, but is not limited to, an elastomer film and a pair of electrodes which sandwich the elastomer film. A first modified type of the elastically deformable film structure 53 may also include, but is not limited to, the periodic stack of elastomer films and electrodes, wherein each elastomer film is sandwiched between adjacent two electrodes, across which a voltage is selectively applied. A second modified type of the elastically deformable film structure 53 may include, but is not limited to, the periodic stack of insulating films and three-layered structures. The three-layered structure is formed by a single elastomer film and two electrodes sandwiching the single elastomer film. Each insulating film is sandwiched between adjacent two three-layered structures of the single elastomer and the two electrodes. Each elastomer film is sandwiched between two paired electrodes, across which a voltage is selectively applied.

The stack direction or the thickness direction of the elastically deformable film structure 53 is parallel to a surface that is shown in FIG. 15 as the elastically deformable film structure 53. The elastically deformable film structure 53 is illustrated in FIGS. 15 and 16 from a side view that is different from the side view from which the elastically deformable film structure 11 is illustrated in FIGS. 2, 9 and 10. The elastically deformable film structure 53 has opposing first and second ends 53*a* and 53*b*. The first end 53*a* of the elastically deformable film structure 53 is fixed to a fixture 55. The fixture 55 may further be fixed to the frame of the keyboard musical instrument. The second end 53*b* of the elastically deformable film structure 53 has a contact member. The contact member is not fixed to, but may be made into contact with, the second end 9*b* of the swingable lever 9. The contact member projects upwardly from the second end 9*b* of the swingable lever 9. In other words, the second end 9*b* of the swingable lever 9 may be supported by, but is not fixed to, the contact member that projects upwardly from the second end 53*b* of the elastically deformable film structure 53.

When the elastically deformable film structure 53 is stretched, then the contact member moves upwardly, thereby pushing the second end 9*b* of the swingable lever 9 upwardly in the direction B. When the elastically deformable film structure 53 is shrunk, then the contact member moves downwardly, thereby allowing the second end 9*b* of the swingable lever 9 to go down in the direction A by its deadweight.

Namely, when the switching circuit 27 is placed in the open state and no voltage is applied across the elastically deformable film structure 53, then the elastically deformable film structure 53 is shrunk, thereby allowing the second end 9*b* of the swingable lever 9 to go down in the direction A by its deadweight until the swingable lever 9 contacts with the first limiting member 15. Thus, the swingable lever 9 is placed in the initial position. When the swingable lever 9 contacts with the first limiting member 15, the contact member projecting upwardly from the second end 53*b* may be either in contact with or separated from the second end 9*b* of the swingable lever 9.

When the switching circuit 27 is switched into the closed state and a voltage is applied across the elastically deformable film structure 53, then the elastically deformable film structure 53 is stretched and the contact member moves upwardly, thereby pushing the second end 9*b* of the swingable lever 9 upwardly in the direction B. The force of stretch of the elastically deformable film structure 53 exceeds the deadweight of the swingable lever 9. The swingable lever 9 is swing-moved around the first fulcrum F1 in the direction B, while the elastically deformable film structure 53 is stretched and the contact member pushes up the second end 9*b* of the swingable lever 9. When the elastically deformable film structure 53 is full-stretched, then the swingable lever 9 is placed at an intermediate position between the first and second limiting members 15 and 17. The key 7 is interlocked with the swingable lever 9. The key 7 is configured to be swing-moved around the second fulcrum F2 while the swingable lever 9 is swing-moved around the first fulcrum F1.

The elastically deformable film structure 53 shows a high speed deformation of stretch in response to the voltage application thereto. The key driving apparatus 51 has sufficiently high initial driving force and speed in driving the key 7 during the initial driving stage.

When the switching circuit 27 is switched from the closed-state into the open-state, then the voltage application across the elastically deformable film structure 53 is discontinued. The elastically deformable film structure 53 is shrunk and the contact member moves down, thereby allowing the second end 9*b* of the swingable lever 9 to go down in the direction A by its deadweight until the swingable lever 9 contacts with the first limiting member 15. Thus, the swingable lever 9 is returned into the initial position.

When the elastically deformable film structure 53 is full-stretched, then the key 7 is half-stroked. When the elastically deformable film structure 53 is full-shrunk, then the key 7 is unstroked and placed in the initial position. The half-stroked or unstroked key 7 is allowed to be pushed down by a finger of a player or performer until the swingable lever 9 contacts with the second limiting member 17. The half-stroked or unstroked key 7 is pushed down, while the second end 9*b* of the swingable lever 9 is moved away from the contact member that projects from the elastically deformable film structure 53. The elastically deformable film structure 53 does not disturb or prevent the swing-motions of the key 7 and the swingable lever 9 in the direction B when the key 7 is pushed down by a finger of a player or performer.

It is preferable that the elastically deformable film structure 53 is interposed or sandwiched by a sandwiching unit 57. The sandwiching unit 57 sandwiches the elastically deformable film structure 53 in a direction that is parallel to the thickness direction of the elastically deformable film structure 53. In a typical case, the sandwiching unit 57 may be realized by a pair of plate members 57*a* and 57*b* that are fixed to the fixture 55. The elastically deformable film structure 53 supports the swingable lever 9. Thus, the elastically deformable film structure 53 is pressed downwardly by the deadweight of the swingable lever 9. The paired plate members 57*a* and 57*b* may effectively prevent the elastically deformable film structure 53 from being buckled by the deadweight of the swingable lever 9.

The key driving apparatus 51 provides the same effects and advantages as those of the above-described key driving apparatus 1.

Figure 17:
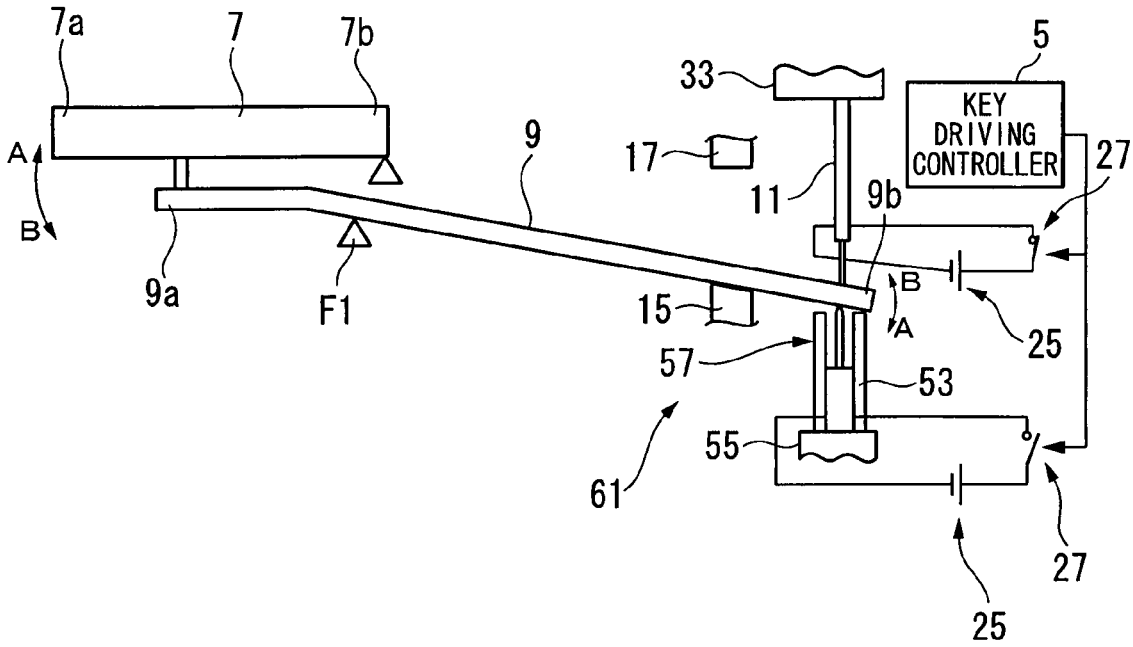
FIG. 17 is a fragmentary cross sectional elevation view illustrating another modified key driving mechanism included in a key driving apparatus that is included in a keyboard musical instrument in accordance with another modified embodiment of the present invention.
Figure 18:
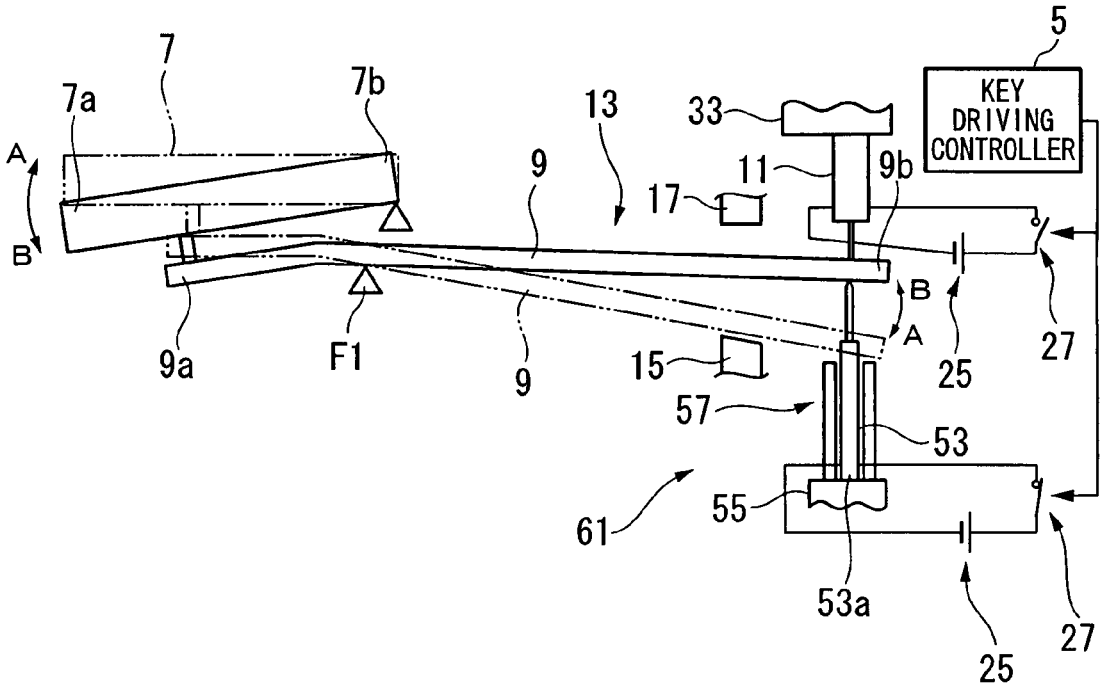
FIG. 18 is a fragmentary cross sectional elevation view illustrating operations of a key driving mechanism shown in FIG. 17.

FIG. 17 is a fragmentary cross sectional elevation view illustrating another modified key driving mechanism included in a key driving apparatus 61 that is included in the keyboard musical instrument in accordance with another modified embodiment of the present invention. FIG. 18 is a fragmentary cross sectional elevation view illustrating operations of the key driving mechanism shown in FIG. 17.

Another modified key driving mechanism for driving each key 7 is different from the above-described key driving mechanism in the followings. The key driving apparatus 61 may include, but is not limited to, the key 7, the swingable lever 9, and the elastically deformable film structures 11 and 53 which are controlled by the key driving controller 5 through the switching circuit 27. The elastically deformable film structure 11 has been described with reference to FIGS. 2, 9, and 10. The elastically deformable film structure 53 has been described with reference to FIGS. 15 and 16. The elastically deformable film structure 11 is provided under the second end 9*b* of the swingable lever 9. The elastically deformable film structure 53 is provided under the second end 9*b* of the swingable lever 9. In a typical case, the elastically deformable film structures 11 and 53 may have the same multi-layered structure.

The switching circuit 27 may be configured to apply a voltage across exclusive one of the elastically deformable film structures 11 and 53, while no voltage being applied across the remaining one of the elastically deformable film structures 11 and 53.

In order to place the key 7 in the initial position, as shown in FIG. 17, the switching circuit 27 is placed in a first state thereby applying the voltage across the elastically deformable film structure 11 while no voltage being applied across the elastically deformable film structure 53. Thus, the elastically deformable film structure 11 is full-stretched, while the elastically deformable film structure 53 is full-shrunk. The swingable lever 9 is swing-moved around the first fulcrum F1 in the direction A so that the second end 9*b* moves down until the swingable lever 9 contacts with the first limiting member 15. The key 7 is interlocked with the swingable lever 9. The key 7 is placed in the initial position.

In order to stroke the key 7 down by the key driving apparatus 61, as shown in FIG. 18, the switching circuit 27 is placed in a second state thereby applying the voltage across the elastically deformable film structure 53 while no voltage being applied across the elastically deformable film structure 11. Thus, the elastically deformable film structure 53 is full-stretched, while the elastically deformable film structure 11 is full-shrunk. The swingable lever 9 is swing-moved around the first fulcrum F1 in the direction B so that the second end 9*b* moves up but the swingable lever 9 does not contact with the second limiting member 17. The key 7 is interlocked with the swingable lever 9. The key 7 is half-stroked.

The switching circuit 27 can be realized by a pair of first and second switching circuits 27 which are electrically coupled to the elastically deformable film structures 11 and 53, respectively. The first and second switching circuits 27 may be configured to receive first and second key driving control signals from the key driving controller 5. The first and second key driving control signals have opposite phases to each other. The exclusive one of the first and second switching circuits 27 is placed in the open state, while the remaining one is placed in the closed state. Switching operations of the switching circuit 27 cause the swingable lever 9 and the key 7 to be swing-moved around the first and second fulcrums F1 and F2, respectively.

The key driving apparatus 61 provides the same effects and advantages as those of the above-described key driving apparatuses 1 and 51. The elastically deformable film structures 11 and 53 have high responsibility or a high speed response to the switching operations of the switching circuit 27. This can obtain sufficiently large initial driving force and speed of the key 7 in the initial phase of driving the key 7.

It is also possible to adjust the level of a voltage that is applied across the elastically deformable film structures 11 and 53. Namely, the amount of stretch or the stretch ratio in the in-plane direction of the elastically deformable film structures 11 and 53 can be adjusted by adjusting the voltage that is applied to the paired electrodes of the elastically deformable film structures 11 and 53. Thus, the range of swing-motion of the key 7 and the swingable lever 9 can be defined by adjusting the voltage that is applied to the paired electrodes of the elastically deformable film structures 11 and 53. It is, for example, possible as a modification to adjust the voltage level so that the swingable lever 9 contacts with the second limiting member 17 when the elastically deformable film structures 11 and 53 are full-shrunk and full-stretched, respectively.

As described above, the first and second limiting members 15 and 17 are provided under and over the swingable lever 9 to limit or define the movable range of the swingable lever 9, thereby indirectly limiting or defining the stroke of the key 7. It is also possible as a modification that the first and second limiting members 15 and 17 are provided under and over the key 7 to directly limit or define the stroke of the key 7. It is possible that the first and second limiting members 15 and 17 are provided to limit or define the swingable motion of the two interlocked elements of the swingable lever 9 and the key 7.

As described above, the elastically deformable film structures 11 and 53 are positioned over and under the send end 9*b* of the swingable lever 9. It is also possible as a modification to change the positions of the elastically deformable film structures 11 and 53 around the two interlocked elements of the key 7 and the swingable lever 9 as long as the two interlocked elements of the key 7 and the swingable lever 9 are swing-moved by elastic deformations of stretch and shrinkage of the elastically deformable film structures 11 and 53. It is, for example, possible that the elastically deformable film structures 11 and 53 are positioned over and under the key 7. For example, the elastically deformable film structures 11 and 53 may respectively be engaged and contact with the key 7 but near the first end 7*a* so that the elastically deformable film structures 11 and 53 directly swing-move the key 7 around the second fulcrum F2.

It is also possible as a modification to provide an extension member which extends from the second end 7*b* of the key 7. The extension member may, for example, extend in the parallel direction to the longitudinal direction of the key 7. The elastically deformable film structures 11 and 53 may respectively be engaged with and contact with the extension member that extends from the second end 7*b* of the key 7. The key 7 with the extension member is swing-moved around the second fulcrum F2 by the elastic deformations of stretch and shrinkage of the elastically deformable film structures 11 and 53.

The swingable lever 9 has the deadweight that acts as the force-applying member 13, thereby applying the force to the key 7 in the upward direction A. The force-applying member 13 may be realized by other member or element than the swingable lever 9. Other typical examples of the force-applying member 13 may include, but are not limited to, known flexible elastic objects used to store mechanical energy, such as nay types of coils, for example, coil spring or leaf spring.

The above described key driving apparatuses 1, 51 and 61 may be applicable to not only the keyboard musical instruments but also other musical instruments that are configured to allow hammers to hit strings, for example, grand pianos and upright pianos.

As described above, the elastically deformable unit may be realized by the polymer material. It is possible as a modification that the elastically deformable unit may also be realized by using an ion exchange resin or conductive polymer such as a polypyrrole resin. Namely, the elastically deformable unit may be realized by an ion conductive actuator using an ion exchange resin, or a conductive polymer actuator using conductive polymer.

As used herein, the following directional terms "forward, rearward, above, downward, vertical, horizontal, below, and transverse" as well as any other similar directional terms refer to those directions of an apparatus equipped with the present invention. Accordingly, these terms, as utilized to describe the present invention should be interpreted relative to an apparatus equipped with the present invention.

The term "configured" is used to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially," "about," and "approximately" as used herein mean a reasonable amount of deviation of the modified term such that the end result is not significantly changed. For example, these terms can be construed as including a deviation of at least ±5 percents of the modified term if this deviation would not negate the meaning of the word it modifies.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A key driving apparatus for driving a key, the apparatus comprising:

a first elastically deformable unit configured to receive a first control voltage, the first elastically deformable unit being configured to show elastic deformations of stretch and shrinkage based on a level of the first control voltage, and the first elastically deformable unit being configured to allow the key to be driven by the elastic deformations of stretch and shrinkage of the first elastically deformable unit, the first elastically deformable unit comprising:

electrodes configured to receive the first voltage; and an elastically deformable polymer film having a dielectric property, the elastically deformable polymer film being interposed between the electrodes, the elastically deformable polymer film being configured to show elastic deformations of stretch and shrinkage based on the level of the first control voltage, the elastic deformations being such that the elastically deformable polymer is stretched in an in-plane direction and shrunken in a thickness direction at a first level of a control voltage, and that the elastically deformable polymer is shrunken in the in-plane direction and stretched in the thickness direction at a second level of the control voltage.

2. The key driving apparatus according to claim 1, further comprising:

an interlocking mechanism configured to mechanically interlock the first elastically deformable unit to the key, the interlocking mechanism being configured to transmit the forces of the elastic deformations of stretch and shrinkage to the key, thereby driving the key.

3. The key driving apparatus according to claim 2, wherein the interlocking mechanism is configured to allow the key to be swing-moved around a first fulcrum by the elastic deformations of stretch and shrinkage.

4. The key driving apparatus according to claim 3, wherein the elastic deformations of stretch and shrinkage include deformations in directions that are parallel to the direction of swing-motion of the key.

5. The key driving apparatus according to claim 2, wherein the interlocking mechanism comprises:

a swing-movable member that has first and second portions, the first portion being coupled to the first elastically deformable unit, the second portion being coupled to the key, and the swing-movable member being configured to be swing-moved around a second fulcrum by the elastic deformations of stretch and shrinkage thereby causing the key to be swing-moved around the first fulcrum.

6. The key driving apparatus according to claim 2, wherein the interlocking mechanism comprises:

a swing-movable member that has first and second portions, the first portion being configured to be contactable with the first elastically deformable unit, the second portion being coupled to the key, and the swing-movable member being configured to be swing-moved around a second fulcrum by the elastic deformations of stretch and shrinkage thereby causing the key to be swing-moved around the first fulcrum.

7. The key driving apparatus according to claim 3, wherein the interlocking mechanism is configured to allow the key to be swing-moved in a first direction by the elastic deformation of shrinkage of the first elastically deformable unit, and the interlocking mechanism is configured to allow the key to be pushed in the first direction by an external force.

8. The key driving apparatus according to claim 2, wherein the first elastically deformable unit comprises: a periodic stack of electrodes and elastically deformable polymer films;

the electrodes being configured to receive the first control voltage; and the elastically deformable polymer films having dielectric property, the elastically deformable polymer films being configured to show the elastic deformations of stretch and shrinkage based on the level of the first control voltage.

9. The key driving apparatus according to claim 2, wherein the first elastically deformable unit comprises: a periodic stack of multi-layered structures and insulating films, each of the multi-layered structures further comprises:

electrodes configured to receive the first control voltage, the electrodes being adjacent to the insulating films, and an elastically deformable polymer film having dielectric property, the elastically deformable polymer film being interposed between the electrodes, the elastically deformable polymer film being configured to show the elastic deformations of stretch and shrinkage based on the level of the first control voltage.

10. The key driving apparatus according to claim 1, further comprising:

rigid members that sandwich the first elastically deformable unit.

11. The key driving apparatus according to claim 2, wherein the first elastically deformable unit has first and second portions, the first portion is fixed to a frame, and the second portion is interlocked to the key through the interlocking mechanism.

12. The key driving apparatus according to claim 2, wherein the interlocking mechanism is configured to apply an additional static force to the key in one of directions along which the key is driven.

13. The key driving apparatus according to claim 12, wherein the additional static force is caused by the deadweight of the interlocking mechanism.

14. The key driving apparatus according to claim 2, further comprising:

a static force applying mechanism configured to apply an additional static force to the key in one of directions along which the key is driven.

15. The key driving apparatus according to claim 1, further comprising:

a first limiting member configured to limit motion of the key thereby defining a first end of a movable range of the key; and a second limiting member configured to limit motion of the key thereby defining a second end of the movable range of the key, wherein the key is moved from the first end to an intermediate between the first and second ends by the elastic deformations of stretch and shrinkage of the first elastically deformable unit, and the key is moved to the second end by an external force.

16. The key driving apparatus according to claim 1, further comprising:

a second elastically deformable unit configured to receive a second control voltage, the second elastically deformable unit being configured to show elastic deformations of stretch and shrinkage based on the level of the second control voltage, and the first and second elastically deformable units being configured to allow the key to be driven by the elastic deformations of stretch and shrinkage of the first and second elastically deformable unit.

17. The key driving apparatus according to claim 1, wherein the first elastically deformable unit comprises a polymer film.

18. A keyboard musical instrument comprising:

a keyboard having keys;

a music performance information generator configured to generate music data for automatic music performance;

a key driving controller coupled to the music performance information generator to receive the music data from the music performance information generator; the key driving controller being configured to generate a key driving control signal based on the music data and generate a first control voltage based on the key driving control signal; and a key driving apparatus coupled to the key driving controller to receive the first control voltage from the key driving controller, the key driving apparatus comprising:

a first elastically deformable unit configured to receive the first control voltage, the first elastically deformable unit being configured to show elastic deformations of stretch and shrinkage based on a level of the first control voltage, and the first elastically deformable unit being configured to allow the key to be driven by the elastic deformations of stretch and shrinkage of the first elastically deformable unit, the first elastically deformable unit comprising:

electrodes configured to receive the first voltage; and an elastically deformable polymer film having a dielectric property, the elastically deformable polymer film being interposed between the electrodes, the elastically deformable polymer film being configured to show elastic deformations of stretch and shrinkage based on the level of the first control voltage, the elastic deformations being such that the elastically deformable polymer is stretched in an in-plane direction and shrunken in a thickness direction at a first level of a control voltage, and that the elastically deformable polymer is shrunken in the in-plane direction and stretched in the thickness direction at a second level of the control voltage.

19. The keyboard musical instrument according to claim 18, further comprising:

a sound generating unit configured to generate musical tones based on the music data, the sound generating unit being configured to synchronize generation of the musical tones with driving the key.

20. The keyboard musical instrument according to claim 19, further comprising:

a detector coupled to the keyboard, the detector being configured to detect that each key is driven, and generate a detection signal, the detector being coupled to the sound generating unit to supply the detection signal to the sound generating unit, and the sound generating unit generates the musical tones based on the detection signal.

21. The keyboard musical instrument according to claim 18, wherein the first elastically deformable unit comprises a polymer film.

* * * * *